US010527973B1

(12) United States Patent
Yamaura et al.

(10) Patent No.: US 10,527,973 B1
(45) Date of Patent: Jan. 7, 2020

(54) IMAGE FORMING APPARATUS

(71) Applicant: FUJI XEROX CO., LTD., Tokyo (JP)

(72) Inventors: Masaaki Yamaura, Kanagawa (JP); Satoshi Shigezaki, Kanagawa (JP); Toshiaki Baba, Kanagawa (JP); Yoshiyuki Tominaga, Kanagawa (JP); Jun Kuwabara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/274,326

(22) Filed: Feb. 13, 2019

(30) Foreign Application Priority Data

Aug. 15, 2018 (JP) ..... 2018-152846

(51) Int. Cl.
*G03G 15/16* (2006.01)
*G03G 15/00* (2006.01)

(52) U.S. Cl.
CPC ..... *G03G 15/1605* (2013.01); *G03G 15/167* (2013.01); *G03G 15/5004* (2013.01)

(58) Field of Classification Search
CPC ..... G03G 15/167; G03G 15/1605; G03G 15/1645; G03G 15/1665; G03G 15/1675
See application file for complete search history.

(56) References Cited

U.S. PATENT DOCUMENTS

2006/0222391 A1* 10/2006 Choi ..... G03G 15/1675 399/66
2011/0008065 A1* 1/2011 Yanagihara ..... G03G 15/1675 399/66
2014/0212158 A1* 7/2014 Adachi ..... G03G 21/0064 399/44
2017/0023890 A1* 1/2017 Amada ..... G03G 15/1675
2018/0373182 A1* 12/2018 Mandai ..... G03G 15/1675

FOREIGN PATENT DOCUMENTS

JP 09-073242 A 3/1997
JP 3346091 B2 11/2002

* cited by examiner

*Primary Examiner* — Thomas S Giampaolo, II
(74) *Attorney, Agent, or Firm* — Sughrue Mion, PLLC

(57) ABSTRACT

An image forming apparatus includes an image holding unit, a transfer unit, a first-resistance detection unit, a second-resistance detection unit, and a selection unit. The image holding unit holds an image. The transfer unit includes a transfer member and a counter member. The transfer member is disposed in contact with an image holding surface of the image holding unit. The counter member is disposed across the image holding unit from the transfer member. The counter member is connected to a transfer power supply to cause a transfer electric field to act on a transfer region between the image holding unit and the transfer member. The transfer unit causes the image held by the image holding unit to be electrostatically transferred onto a recording medium transported to the transfer region. The first-resistance detection unit detects system resistance of the counter member, the image holding unit, and the transfer member. The second-resistance detection unit detects system resistance of the counter member alone or system resistance of the counter member and the image holding unit. The selection unit selects the first-resistance detection unit or the second-resistance detection unit, depending on a type of the recording medium.

10 Claims, 17 Drawing Sheets

FIG. 13

| LEVEL NO. | COUNTER ROLLER | BELT TRANSFER MODULE | FIRST-RESISTANCE DETECTION MODE | | SECOND-RESISTANCE DETECTION MODE | |
|---|---|---|---|---|---|---|
| | | | WHITE | WHITE + BLUE | WHITE | WHITE + BLUE |
| (1) | HIGH (7.6 log Ω) | HIGH (10.0 log Ω) | DESIRED VALUE | DESIRED VALUE | DESIRED VALUE | DESIRED VALUE |
| (2) | HIGH (7.6 log Ω) | MEDIUM (9.2 log Ω) | DESIRED VALUE | UNDESIRED VALUE | DESIRED VALUE | DESIRED VALUE |
| (3) | HIGH (7.6 log Ω) | LOW (8.5 log Ω) | DESIRED VALUE | UNDESIRED VALUE | DESIRED VALUE | DESIRED VALUE |
| (4) | MEDIUM (7.3 log Ω) | HIGH (10.0 log Ω) | UNDESIRED VALUE | DESIRED VALUE | DESIRED VALUE | DESIRED VALUE |
| (5) | MEDIUM (7.3 log Ω) | MEDIUM (9.2 log Ω) | DESIRED VALUE | DESIRED VALUE | DESIRED VALUE | DESIRED VALUE |
| (6) | MEDIUM (7.3 log Ω) | LOW (8.5 log Ω) | DESIRED VALUE | UNDESIRED VALUE | DESIRED VALUE | DESIRED VALUE |
| (7) | LOW (7.0 log Ω) | HIGH (10.0 log Ω) | UNDESIRED VALUE | DESIRED VALUE | DESIRED VALUE | DESIRED VALUE |
| (8) | LOW (7.0 log Ω) | MEDIUM (9.2 log Ω) | UNDESIRED VALUE | DESIRED VALUE | DESIRED VALUE | DESIRED VALUE |
| (9) | LOW (7.0 log Ω) | LOW (8.5 log Ω) | DESIRED VALUE | DESIRED VALUE | DESIRED VALUE | DESIRED VALUE |

FIG. 15

| LEVEL NO. | COUNTER ROLLER | BELT TRANSFER MODULE | FIRST-RESISTANCE DETECTION MODE | | SECOND-RESISTANCE DETECTION MODE | |
|---|---|---|---|---|---|---|
| | | | WHITE | WHITE + BLUE | WHITE | WHITE + BLUE |
| (1) | HIGH (7.6 log Ω) | HIGH (10.0 log Ω) | DESIRED VALUE | DESIRED VALUE | DESIRED VALUE | DESIRED VALUE |
| (2) | HIGH (7.6 log Ω) | MEDIUM (9.2 log Ω) | DESIRED VALUE | DESIRED VALUE | UNDESIRED VALUE | DESIRED VALUE |
| (3) | HIGH (7.6 log Ω) | LOW (8.5 log Ω) | DESIRED VALUE | DESIRED VALUE | UNDESIRED VALUE | DESIRED VALUE |
| (4) | MEDIUM (7.3 log Ω) | HIGH (10.0 log Ω) | DESIRED VALUE | DESIRED VALUE | DESIRED VALUE | UNDESIRED VALUE |
| (5) | MEDIUM (7.3 log Ω) | MEDIUM (9.2 log Ω) | DESIRED VALUE | DESIRED VALUE | DESIRED VALUE | DESIRED VALUE |
| (6) | MEDIUM (7.3 log Ω) | LOW (8.5 log Ω) | DESIRED VALUE | DESIRED VALUE | UNDESIRED VALUE | DESIRED VALUE |
| (7) | LOW (7.0 log Ω) | HIGH (10.0 log Ω) | DESIRED VALUE | DESIRED VALUE | DESIRED VALUE | UNDESIRED VALUE |
| (8) | LOW (7.0 log Ω) | MEDIUM (9.2 log Ω) | DESIRED VALUE | DESIRED VALUE | DESIRED VALUE | UNDESIRED VALUE |
| (9) | LOW (7.0 log Ω) | LOW (8.5 log Ω) | DESIRED VALUE | DESIRED VALUE | DESIRED VALUE | DESIRED VALUE |

FIG. 16

| LEVEL NO. | COUNTER ROLLER | BELT TRANSFER MODULE | SHEET RESISTANCE | FIRST-RESISTANCE DETECTION MODE | | SECOND-RESISTANCE DETECTION MODE | |
|---|---|---|---|---|---|---|---|
| | | | | WHITE | WHITE + BLUE | WHITE | WHITE + BLUE |
| (3) | HIGH (7.6 log Ω) | LOW (8.5 log Ω) | 13.1 log Ω | DESIRED VALUE | DESIRED VALUE | UNDESIRED VALUE | DESIRED VALUE |
| | | | 10.9 log Ω | DESIRED VALUE | DESIRED VALUE | UNDESIRED VALUE | DESIRED VALUE |
| | | | 9.7 log Ω | DESIRED VALUE | DESIRED VALUE | UNDESIRED VALUE | DESIRED VALUE |
| | | | 8.2 log Ω | DESIRED VALUE | DESIRED VALUE | UNDESIRED VALUE | DESIRED VALUE |
| | | | 8.0 log Ω | DESIRED VALUE | UNDESIRED VALUE | DESIRED VALUE | DESIRED VALUE |
| | | | 7.2 log Ω | DESIRED VALUE | UNDESIRED VALUE | DESIRED VALUE | DESIRED VALUE |
| (7) | LOW (7.0 log Ω) | HIGH (10.0 log Ω) | 13.1 log Ω | DESIRED VALUE | DESIRED VALUE | DESIRED VALUE | UNDESIRED VALUE |
| | | | 10.9 log Ω | DESIRED VALUE | DESIRED VALUE | DESIRED VALUE | UNDESIRED VALUE |
| | | | 9.7 log Ω | DESIRED VALUE | DESIRED VALUE | DESIRED VALUE | UNDESIRED VALUE |
| | | | 8.2 log Ω | DESIRED VALUE | DESIRED VALUE | DESIRED VALUE | UNDESIRED VALUE |
| | | | 8.0 log Ω | UNDESIRED VALUE | DESIRED VALUE | DESIRED VALUE | DESIRED VALUE |
| | | | 7.2 log Ω | UNDESIRED VALUE | DESIRED VALUE | DESIRED VALUE | DESIRED VALUE |

IMAGE FORMING APPARATUS

CROSS-REFERENCE TO RELATED APPLICATIONS

This application is based on and claims priority under 35 USC 119 from Japanese Patent Application No. 2018-152846 filed Aug. 15, 2018.

BACKGROUND

(i) Technical Field

The present disclosure relates to an image forming apparatus.

(ii) Related Art

To date, image forming apparatuses described in, for example, Japanese Patent No. 3346091 and Japanese Unexamined Patent Application Publication No. 9-73242 are known as an image forming apparatus similar to an image forming apparatus described herein.

Japanese Patent No. 3346091 (Exemplary Embodiment and FIG. 1) discloses a transfer voltage control method including detecting current flowing through a bias roller in contact with an image carrier after applying a measurement voltage to the bias roller, detecting current flowing through the bias roller brought into contact with a grounding member after applying a voltage to the bias roller, and determining a transfer voltage to be used for toner image transfer on the basis of two current values respectively detected in the two detection steps.

Japanese Unexamined Patent Application Publication No. 9-73242 (Exemplary Embodiment and FIGS. 2 and 3) discloses an image forming apparatus including a semiconductive back-up roller, a conductive roller, a transfer-voltage application circuit, a transfer-voltage computing circuit, and a transfer-voltage control circuit. The back-up roller supports an intermediate transfer body on the back surface side of the intermediate transfer body and at a position where the back-up roller faces a second transfer roller. A toner image corresponding to image information is held by a latent image carrier, and first transfer of the toner image is performed from the latent image carrier onto the surface of the intermediate transfer body. The second transfer roller is in contact with the surface of the intermediate transfer body, and second transfer of the toner image is performed onto a recording medium. The conductive roller is disposed in contact with the back-up roller. The transfer-voltage application circuit applies a transfer voltage to the second transfer roller and the back-up roller. The transfer-voltage computing circuit determines a transfer voltage to be applied to the second transfer roller in accordance with a detection signal from a resistance detection circuit that detects a resistance value of the back-up roller when the second transfer roller is retracted. The transfer-voltage control circuit controls the transfer-voltage application circuit on the basis of computing output from the transfer-voltage computing circuit.

SUMMARY

Aspects of non-limiting embodiments of the present disclosure relate to enabling, to be set, transfer conditions respectively suitable for different types of recording media that pass through the transfer region of a transfer unit compared with a method by which a transfer condition is set by detecting the system resistance of a component of the transfer unit without variation.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding unit, a transfer unit, a first-resistance detection unit, a second-resistance detection unit, and a selection unit. The image holding unit holds an image. The transfer unit includes a transfer member and a counter member. The transfer member is disposed in contact with an image holding surface of the image holding unit. The counter member is disposed across the image holding unit from the transfer member. The counter member is connected to a transfer power supply to cause a transfer electric field to act on a transfer region between the image holding unit and the transfer member. The transfer unit causes the image held by the image holding unit to be electrostatically transferred onto a recording medium transported to the transfer region. The first-resistance detection unit detects system resistance of the counter member, the image holding unit, and the transfer member. The second-resistance detection unit detects system resistance of the counter member alone or system resistance of the counter member and the image holding unit. The selection unit selects the first-resistance detection unit or the second-resistance detection unit, depending on a type of the recording medium.

BRIEF DESCRIPTION OF THE DRAWINGS

An exemplary embodiment of the present disclosure will be described in detail based on the following figures, wherein:

FIG. 13 is an explanatory table illustrating a list of results of operation of the image forming apparatus according to Example 1;

FIG. 15 is an explanatory table illustrating a list of results of operation of the image forming apparatus according to Example 2;

FIG. 16 is an explanatory table illustrating a list of results of operation of an image forming apparatus according to Example 3.

DETAILED DESCRIPTION

Exemplary Embodiment Overview

Figure 1A:
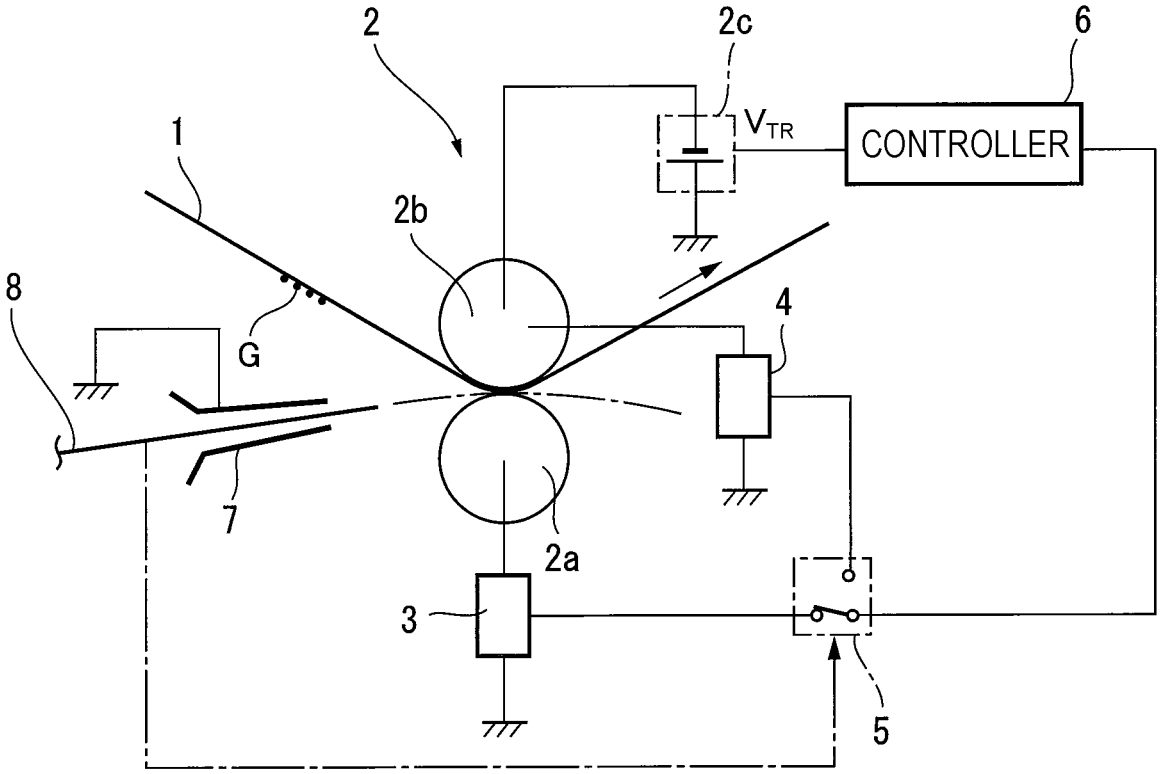
FIG. 1A is an explanatory diagram illustrating the overview of an exemplary embodiment of an image forming apparatus to which the present disclosure is applied.

FIG. 1A is an explanatory diagram illustrating the overview of an exemplary embodiment of an image forming apparatus to which the present disclosure is applied.

In FIG. 1A, the image forming apparatus includes an image holding unit 1 that holds an image G, a transfer unit 2, a first-resistance detection unit 3, a second-resistance detection unit 4, and a selection unit 5. The transfer unit 2 includes a transfer member 2*a* in contact with the image holding surface of the image holding unit 1, a counter member 2*b* disposed across the image holding unit 1 from the transfer member 2*a*, and a transfer power supply 2*c*. The transfer power supply 2*c* is connected to the counter member 2*b* to cause a transfer electric field to act on a transfer region between the transfer member 2*a* and the image holding unit 1, and the transfer unit 2 electrostatically transfers the image G held on the image holding unit 1 onto a recording medium 8 transported to the transfer region. The first-resistance detection unit 3 detects the system resistance of the counter member 2*b*, the image holding unit 1, and the transfer member 2*a*. The second-resistance detection unit 4 detects the system resistance of the counter member 2*b* alone or the system resistance of the image holding unit 1 and the counter member 2*b*. The selection unit 5 selects the first-resistance detection unit 3 or the second-resistance detection unit 4, depending on the type of the recording medium 8.

In FIG. 1A, a controller 6 controls a transfer voltage $V_{TR}$ to be output from the transfer power supply 2*c*. The controller controls the transfer voltage $V_{TR}$ on the basis of the system resistance detected by the first-resistance detection unit 3 or the second-resistance detection unit 4.

Among the technical units as described above, the image holding unit 1 is typically regarded as an intermediate transfer body based on an intermediate transfer method. However, the intermediate transfer body includes a photo conductor and a dielectric based on a direct transfer method other than the intermediate transfer method.

In addition, as long as the transfer unit 2 includes the transfer member 2*a*, the counter member 2*b*, and the transfer power supply 2*c* connected to the counter member 2*b*, the transfer unit 2 may be in any form. For example, the transfer member 2*a* may be in a form of a roller, a belt, or the like. However, an aspect in which the transfer unit 2 includes a transfer power supply connected to the transfer member 2*a* is excluded from aspects of the disclosure because it is not possible to perform a transfer operation on a low-resistance recording medium in the aspect.

In the present disclosure, the attention is focused on a transfer current path varying with the type of the recording medium 8, and a point that a suitable system resistance is detected by selecting one of the first-resistance detection unit 3 and the second-resistance detection unit 4 in two respective systems depending on the type of the recording medium 8 is regarded as a technical feature.

Typical or desirable aspects of the image forming apparatus according to this exemplary embodiment will be described.

Figure 1B:
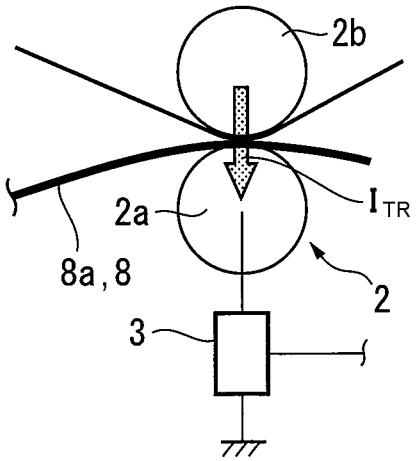
FIG. 1B is an explanatory diagram illustrating a resistance detection operation performed by a first-resistance detection unit.
Figure 1C:
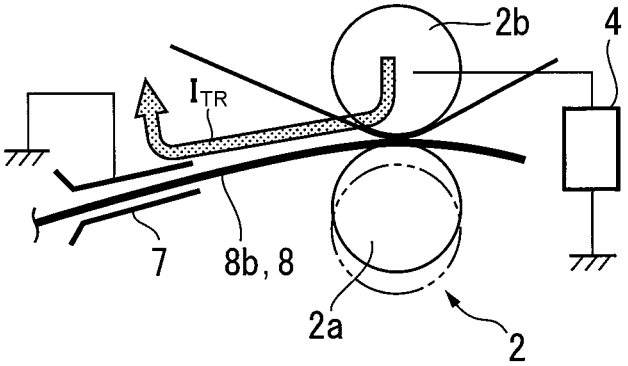
FIG. 1C is an explanatory diagram illustrating a resistance detection operation performed by a second-resistance detection unit.

In an aspect of a resistance value focused on in discrimination of the type of the recording medium 8, the selection unit 5 selects the first-resistance detection unit 3 when the recording medium 8 is a non-low-resistance recording medium 8*a* having a resistance value higher than a predetermined resistance value, and the selection unit 5 selects the second-resistance detection unit 4 when the recording medium 8 is a low-resistance recording medium 8*b* having a resistance value lower than or equal to the predetermined resistance value. In this example, in the case of the non-low-resistance recording medium 8*a* having a resistance value higher than the predetermined resistance value, a transfer electric field is generated from the recording medium 8*a* via the transfer member 2*a* as illustrated in FIG. 1B. In contrast, in the case of the low-resistance recording medium 8*b* having a resistance value lower than or equal to the predetermined resistance value, a transfer electric field is generated, extending along the recording medium 8*b* to a contact unit 7 (such as a recording medium guide member), instead of the transfer member 2*a*, as illustrated in FIG. 1C. The contact unit 7 is in contact with the recording medium 8*b* and is grounded. The system resistances corresponding to the respective media are thereby detectable. In FIGS. 1B and 1C, reference $I_{TR}$ denotes transfer current of each transfer electrical field acting on the corresponding recording medium 8*a* or 8*b*.

In the aspect of a resistance value focused on in discrimination of the type of the recording medium 8, the selection unit 5 may select the second-resistance detection unit 4 when the recording medium 8 is the low-resistance recording medium 8*b* having a surface resistance lower than or equal to 8 log Ω.

In an aspect of the presence of a conductive layer focused on in discrimination of the type of the recording medium 8, the selection unit 5 selects the second-resistance detection unit 4 when the recording medium 8 has a conductive layer along the surface of the medium base material. In this example, for example, if the recording medium 8 has a conductive layer on the surface of the medium base material, but if the conductive layer is coated with a high-resistance surface layer, the recording medium 8 is not included in the low-resistance recording medium in some cases in terms of a resistance value measured by a measurement method such as Japanese Industrial standards (JIS). However, when a high transfer voltage is applied to the recording medium 8 having a conductive layer of this type, the recording medium 8 exhibits a behavior of an apparent low resistance, that is, the recording medium 8 is conducted along the surface. Accordingly, the recording medium 8 is handled as the low-resistance recording medium 8*b*.

Further, in an aspect of a black recording medium focused on in discrimination of the type of the recording medium 8, the selection unit 5 selects the second-resistance detection unit 4 when the recording medium 8 is a black recording medium having a medium base material containing a conducting agent. In this example, the black recording medium having the medium base material containing the conducting agent (for example, carbon black) has a resistance value lower than or equal to the predetermined resistance value in many cases. However, even though the recording medium 8 has a resistance value higher than the predetermined resistance value, the recording medium 8 exhibits a behavior of an apparent low resistance, that is, the recording medium 8 is conducted along the surface due to the conducting agent contained in the medium base material, depending on the type. The recording medium 8 is thus handled as the low-resistance recording medium 8*b*.

In a desirable aspect of the transfer unit 2, the transfer member 2*a* is retracted from the image holding unit 1 to a non-contact position when the selection unit 5 selects the second-resistance detection unit 4. In this example, when the selection unit 5 selects the second-resistance detection unit 4, the transfer member 2*a* is retracted from the image holding unit 1 to the non-contact position, and a current-carrying path from the recording medium 8 to the transfer member 2*a* is blocked.

In a typical aspect of the transfer unit 2 based on a retraction method, a gap between the image holding unit 1 and the transfer member 2*a* is set to prevent a voltage higher than or equal to a discharging start voltage from acting when the transfer unit 2 causes the transfer member 2*a* to be retracted from the image holding unit 1 to the non-contact position. This example provides reference for setting the degree of the length of a needed gap between the image holding unit 1 and the transfer member 2*a*.

A typical aspect of the second-resistance detection unit 4 is an ammeter that measures current flowing through the counter member 2*b* when the transfer power supply 2*c* applies a system-resistance detection voltage to the counter member 2*b* in a state where the transfer member 2*a* is retracted from the image holding unit 1. In this example, when the second-resistance detection unit 4 is selected, the transfer member 2*a* is retracted from the image holding unit 1. The current flowing through the counter member 2*b* is measured without a recording medium for system resistance detection, and a system resistance is thereby detected.

Another typical aspect of the second-resistance detection unit 4 is an ammeter that measures current flowing to the contact unit 7 when the transfer power supply 2*c* applies a system-resistance detection voltage to the counter member 2*b* in a state where a recording medium used for system resistance detection lies between the transfer region and the contact unit 7. The transfer region is located between the image holding unit 1 and the transfer member 2*a*. The contact unit 7 is located upstream of the transfer region in a direction of transporting the recording medium 8 and is grounded. In this example, with the recording medium 8 for system resistance detection placed between the transfer region and the contact unit 7, current flowing to the contact unit 7 that is located upstream in the direction of transporting the recording medium 8 and that is grounded is measured, and the system resistance is thereby detected.

Exemplary Embodiment 1

Overall Configuration of Image Forming Apparatus

Hereinafter, the disclosure will be described in more detail on the basis of an exemplary embodiment illustrated in the attached drawings.

Figure 2:
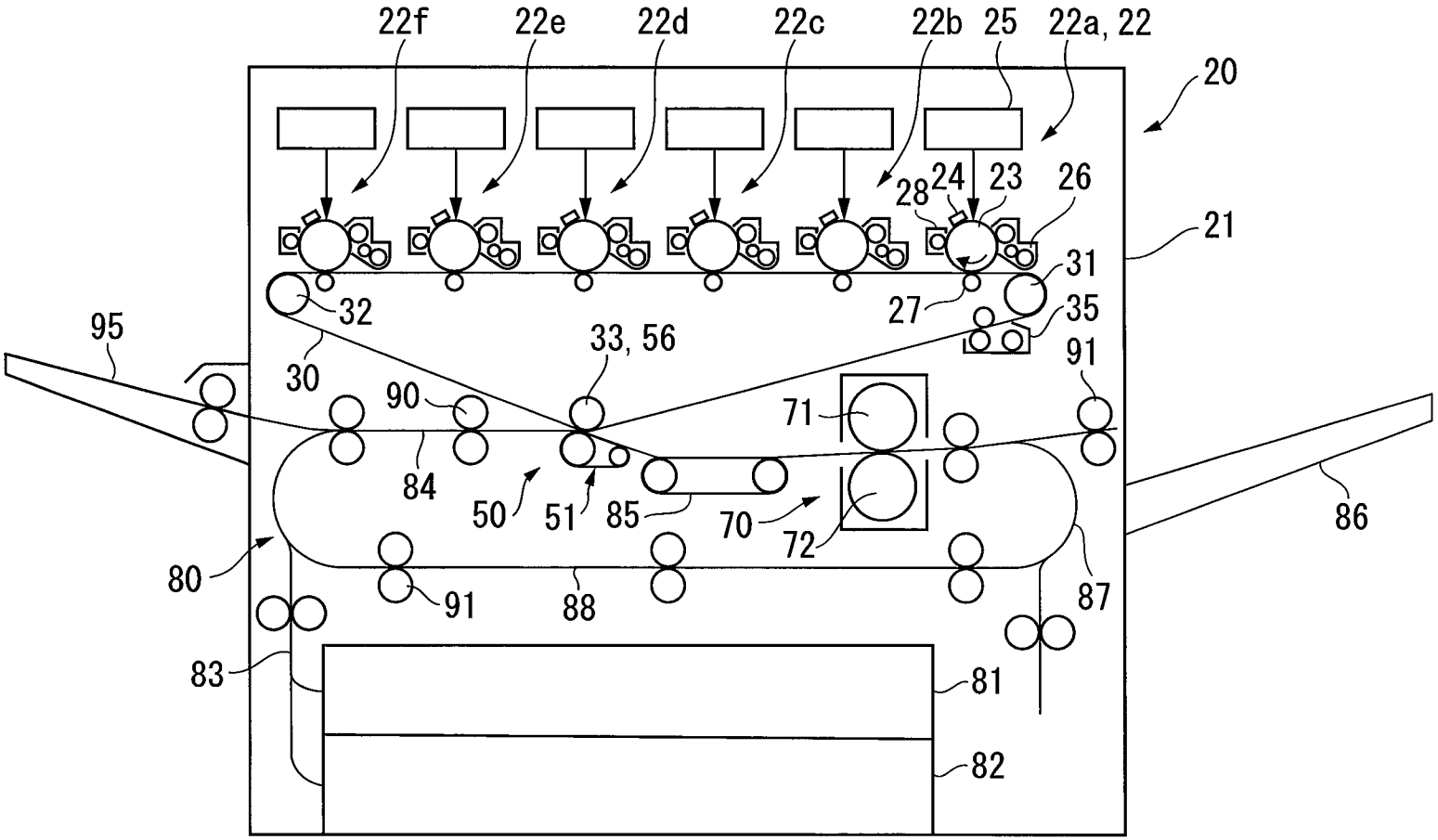
FIG. 2 is an explanatory diagram illustrating the overall configuration of an image forming apparatus according to Exemplary Embodiment 1.

FIG. 2 is an explanatory diagram illustrating the overall configuration of an image forming apparatus according to Exemplary Embodiment 1.

In FIG. 2, an image forming apparatus 20 includes image forming units 22 (specifically 22*a* to 22*f*), an intermediate transfer body 30 in a belt form, a second transfer device 50 (collective transfer device), a fixing device 70, and a sheet transport system 80 that are disposed inside an image-forming-apparatus housing 21. The image forming units 22 respectively form multiple color component images (white #1, yellow, magenta, cyan, black, and white #2 in this exemplary embodiment). The intermediate transfer body 30 in order transfers and holds the color component images formed by the respective image forming units 22 (first transfer). The second transfer device 50 performs second transfer (collective transfer) of the color component images transferred on the intermediate transfer body 30 on a sheet S serving as a recording medium (see FIG. 3). The fixing device 70 fixes an image resulting from the second transfer on the sheet S. The sheet transport system 80 transports the sheet S to a second transfer region. Although completely the same white material is used for white #1 and white #2 in this example, different white materials may be used, as a matter of course, in accordance with the locations of the corresponding images on the sheet S, that is, if the images are respectively located on upper and lower layers than the layer of a different color component image. In addition, for example, a transparent material may be used instead of white #1 for one of the white images.

Image Forming Unit

In this exemplary embodiment, the image forming units 22 (22*a* to 22*f*) respectively have photo conductors 23 of a drum shape. Around each photo conductor 23, a charging device 24 such as a corotron charger, an exposing device 25 such as a laser scanning device, a developing device 26, a first transfer device 27, and a photo conductor cleaning device 28 are arranged. The charging device 24 charges the photo conductor 23. The exposing device 25 are used for writing an electrostatic latent image on the charged photo conductor 23. The developing device 26 develops the electrostatic latent image on the photo conductor 23 by using the corresponding color component toner. The first transfer device 27 transfers the toner image on the photo conductor 23 onto the intermediate transfer body 30. The photo conductor cleaning device 28 removes the toner remaining on the photo conductor 23.

The intermediate transfer body 30 is stretched around multiple (in this exemplary embodiment, three) tension rollers 31 to 33. For example, the tension roller 31 serves as a driving roller driven by a drive motor (not illustrated) and causes the intermediate transfer body 30 to move circularly. Further, an intermediate-transfer-body cleaning device 35 for removing the toner remaining on the intermediate transfer body 30 after the second transfer is disposed between the tension rollers 31 and 33.

Second Transfer Device (Collective Transfer Device)

Figure 3:
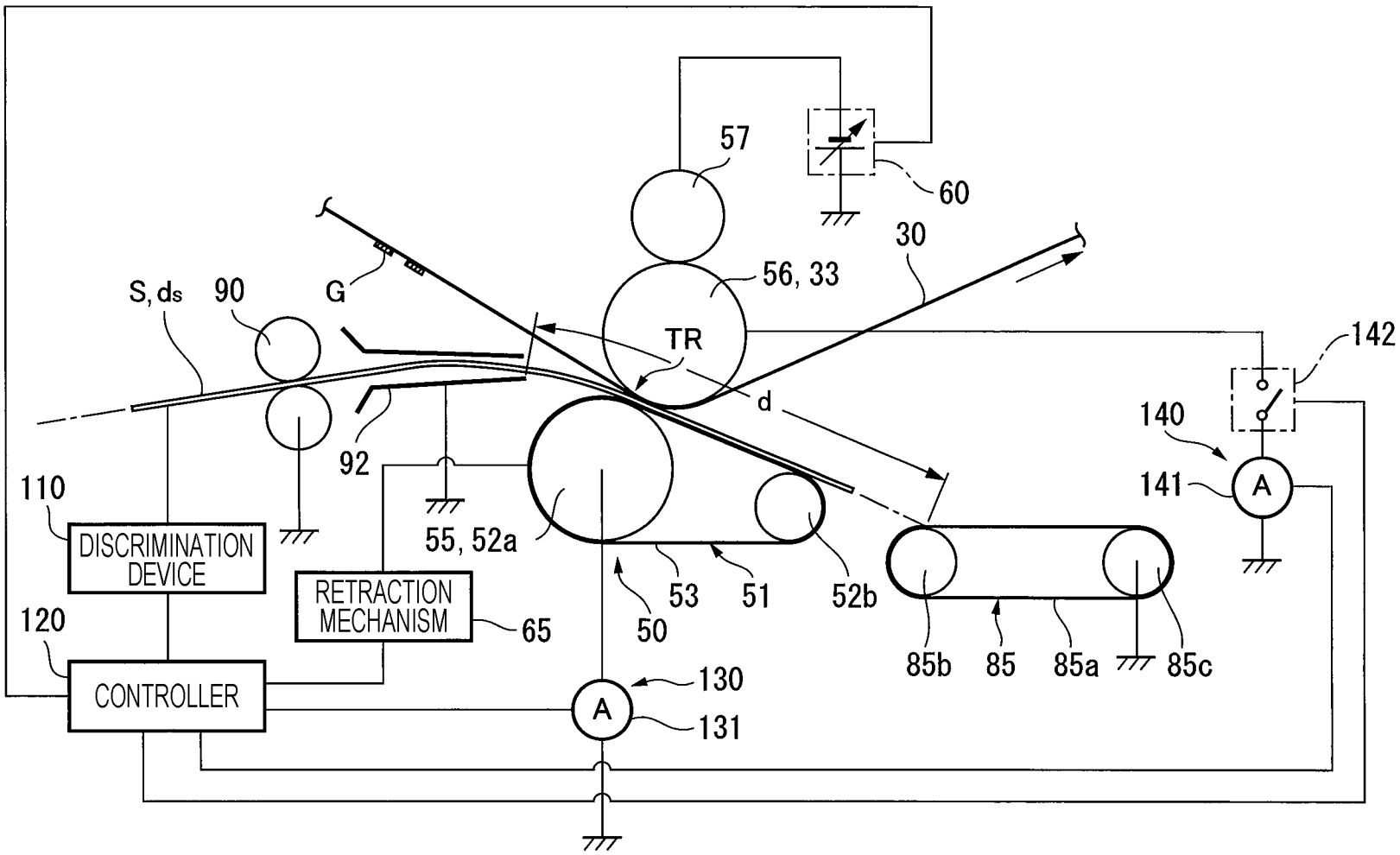
FIG. 3 is an explanatory diagram illustrating the detailed configuration of components around a second transfer unit according to Exemplary Embodiment 1.

Further, in the second transfer device (collective transfer device) 50, as illustrated in FIGS. 2 and 3, a belt transfer module 51 including a transfer and transport belt 53 stretched around multiple (for example, two) tension rollers 52 (specifically, 52*a* and 52*b*) is disposed in contact with the surface of the intermediate transfer body 30. In particular in this example, the belt transfer module 51 is supported by a retraction mechanism 65 in a retractable manner and may be separated from and be brought into contact with the intermediate transfer body 30.

The transfer and transport belt 53 is a semiconductive belt formed of a material such as chroloprene with a volume resistivity of $10^6$ Ω·cm to $10^{12}$ Ω·cm. The tension roller 52*a* that is one of the tension rollers 52 serves as an elastic transfer roller 55, and the elastic transfer roller 55 is arranged in a second transfer region (collective transfer region) TR in such a manner as to be pressed against the intermediate transfer body 30 across the transfer and transport belt 53. The tension roller 33 of the intermediate transfer body 30 is arranged as a counter roller 56 serving as a counter electrode with respect to the elastic transfer roller 55, facing the elastic transfer roller 55. The transfer and transport belt 53 thus forms a transport path for the sheet S from the position of the tension roller 52*a* as one of the tension rollers 52 toward the position of the tension roller 52*b* as the other one of the tension rollers 52.

In this example, the elastic transfer roller 55 has a metal shaft coated with urethane foam rubber or an elastic layer having ethylene propylen dien monomer (EPDM) mixed with carbon black or the like. In this example, the tension rollers 52 (52*a* and 52*b*) of the belt transfer module 51 are each grounded and prevent the transfer and transport belt 53 from being charged. In consideration of separability of the sheet S at the most downstream position of the transfer and transport belt 53, it is effective that the downstream tension roller 52*b* functions as a separation roller having a diameter smaller than that of the upstream tension roller 52*a*.

Further, a transfer voltage $V_{TR}$ is applied from a transfer power supply 60 to the counter roller 56 (also serving as the tension roller 33 in this example) via a conductive power-supply roller 57, and a predetermined transfer electric field is generated between the elastic transfer roller 55 and the counter roller 56.

Fixing Device

As illustrated in FIG. 2, the fixing device 70 includes a heat-fixing roller 71 and a pressure-fixing roller 72. The heat-fixing roller 71 is arranged in contact with the image holding surface of the sheet S and is rotatably driven. The pressure-fixing roller 72 is arranged in such a manner as to face and be pressed against the heat-fixing roller 71 and is rotated in accordance with the heat-fixing roller 71. An image held on the sheet S passes through the transfer region between the heat-fixing roller 71 and the pressure-fixing roller 72 and is thereby heated, pressed, and then fixed.

Sheet Transport System

Further, as illustrated in FIGS. 2 and 3, the sheet transport system 80 includes multiple (in this example, two) sheet supply containers 81 and 82 stacked on top of each other. The sheet S supplied from one of the sheet supply containers 81 and 82 is transported from a vertical transport path 83 extending substantially vertically to a horizontal transport path 84 extending substantially horizontally and reaches the second transfer region TR. Thereafter, the sheet S having the transferred image held thereon is transported via a transport belt 85 and reaches the fixing part of the fixing device 70. The sheet S then exits into a sheet exit tray 86 disposed on a side of the image-forming-apparatus housing 21.

The sheet transport system 80 further includes a branched transport path 87 that allows the sheet S to be turned over and that branches downwards from a part, of the horizontal transport path 84, downstream of the fixing device 70 in a sheet transport direction. The sheet S turned over on the branched transport path 87 is returned to the horizontal transport path 84 via a return transport path 88 and the vertical transport path 83, an image is transferred on the back surface of the sheet S in the second transfer region TR, and the sheet S exits into the sheet exit tray 86 via the fixing device 70.

The sheet transport system 80 is also provided with not only registration rollers 90 that register the sheet S and then supply the sheet S to the second transfer region TR but also an appropriate number of transport rollers 91 on the transport paths 83, 84, 87, and 88.

Further, a manual sheet feeder 95 allowing a sheet to be fed manually toward the horizontal transport path 84 is disposed on the opposite side of the image-forming-apparatus housing 21 from the sheet exit tray 86.

Guide Chute

Further, a guide chute 92 that guides the sheet S having passed between the registration rollers 90 to the second transfer region TR is disposed on the entrance side of the second transfer region TR of the horizontal transport path 84. In this example, as the guide chute 92, paired metal plates formed of stainless used steel (SUS) are disposed with a predetermined slope. The guide chute 92 regulates the entering posture of the sheet S to enter the second transfer region TR and is directly grounded. Although one guide chute 92 located between the registration rollers 90 and the second transfer region TR is described in this example, the number of guide chutes 92 is not necessarily one, and multiple guide chutes 92 may be provided, as a matter of course.

Sheet Type

As the sheet S usable in this example, not only an ordinary paper sheet, for example, with a surface resistance of 10 log Ω/sq to 12 log Ω/sq but also a low-resistance sheet Sm with a surface resistance (for example, a surface resistance of 8 log Ω/sq or lower) lower than that of the ordinary paper sheet are cited.

Figure 4A:
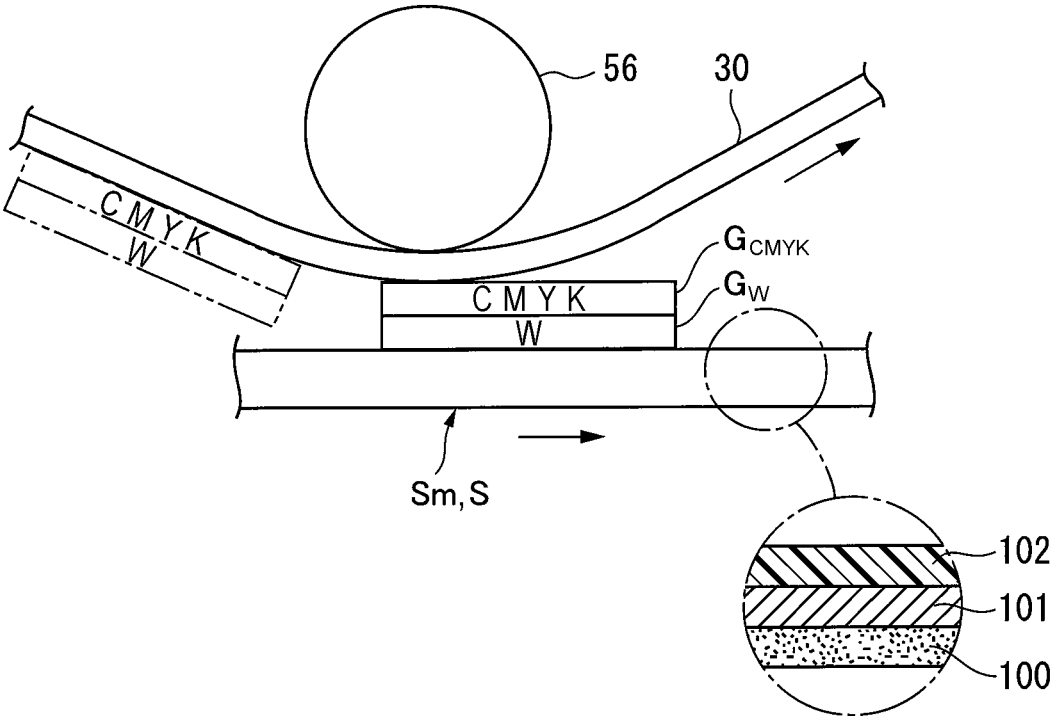
FIG. 4A is an explanatory diagram illustrating an example of imaging performed on a low-resistance sheet by the image forming apparatus according to Exemplary Embodiment 1.

In a typical aspect of the low-resistance sheet Sm, there is a so-called metallic sheet including a base-material layer 100, a metal layer 101, and a surface layer 102 as illustrated in, for example, FIG. 4A. The metal layer 101 such as an aluminum layer is stacked on the base-material layer 100 formed of a sheet base material, and the metal layer 101 is coated with the surface layer 102 formed of a synthesis resin such as polyethylene terephthalate (PET). There is also a metallic sheet including a bond formed of PET or the like between the base-material layer 100 and the metal layer 101.

The metallic sheets of this type include not only a metallic sheet with a surface resistance value lower than or equal to a predetermined surface resistance value (for example, 8 log Ω/sq) but also another metallic sheet such as a metallic sheet including the surface layer 102 formed of, for example, a high resistance material. Specifically, although the resistance value of the metallic sheet measured by a surface resistance measurement method conforming to Japanese Industrial standards (JIS) is not at the threshold level or lower, the resistance of the metallic sheet substantially acts as a low resistance when a high transfer voltage $V_{TR}$ is applied.

On a metallic sheet that is the low-resistance sheet Sm of this type, for example, a CMYK (cyan, magenta, yellow, and black) color image may be directly formed. However, an image with good color forming properties may thereby be obtained in the following manner. As illustrated in, for example, FIG. 4A, a white image $G_W$ as a base image in white W is formed on the metallic sheet by using, for example, an image forming unit 22*f* illustrated in FIG. 2, and a color image $G_{CMYK}$ in CMYK is formed on the white image $G_W$ by using the image forming units 22*b* to 22*e* illustrated in FIG. 2.

The low-resistance sheet Sm includes a black paper sheet containing a conducting agent such as carbon black, a black coated-paper sheet in which a coat layer containing a conducting agent such as carbon black is formed on a general cardboard, and the like. The black paper sheet of this type includes not only a black paper sheet with a predetermined surface resistance value (for example, 8 log Ω or lower) but also a black paper sheet having, for example, a high resistance transparent coat layer. Specifically, although the surface resistance value of the black paper sheet measured by a surface resistance measurement method conforming to Japanese Industrial standards (JIS) is not at the threshold level, the resistance substantially acts as a low resistance when a high transfer voltage $V_{TR}$ is applied.

Example Configuration of Discrimination Device

In this example, as illustrated in FIG. 3, a discrimination device 110 for discriminating a sheet type is provided on the vertical transport path 83 of the sheet transport system 80 or part of the horizontal transport path 84. In the discrimination device 110, as illustrated in, for example, FIG. 4B, paired discrimination rollers 111 and paired discrimination rollers 112 are installed side by side in the direction of transporting the sheet S. A discrimination power supply 113 is connected to one of the paired discrimination rollers 111 that are located upstream in the direction of transporting the sheet S, and the other is grounded via a resistor 114. An ammeter 115 is disposed between one of the paired discrimination rollers 112 located downstream in the direction of transporting the sheet S and the ground. Note that the members for transporting the sheet S (the registration rollers 90 and the transport rollers 91) may also serve as the discrimination rollers 111 and the discrimination rollers 112, or the discrimination rollers 111 and the discrimination rollers 112 may be installed apart from the transport members.

In this example, for example, assume that an ordinary paper sheet (included in a non-low-resistance sheet other than a low-resistance sheet) is used as the sheet S. The ordinary paper sheet has a high surface resistance to a certain degree. Accordingly, even if the ordinary paper sheet lies between the paired discrimination rollers 111 and the paired discrimination rollers 112, current for discrimination from the discrimination power supply 113 flows across the paired discrimination rollers 111, as illustrated by dotted lines in FIG. 4B, and almost no current flows along the sheet S and reaches the ammeter 115 close to the discrimination rollers 112.

In contrast, assume that a low-resistance sheet such as a metallic sheet is used as the sheet S. The low-resistance sheet has a surface resistance lower than that of the ordinary paper sheet. Accordingly, if the low-resistance sheet lies between the paired discrimination rollers 111 and the paired discrimination rollers 112, some of the current for discrimination from the discrimination power supply 113 flows across the paired discrimination rollers 111 as illustrated by solid lines in FIG. 4B, and remaining current for discrimination flows along the sheet S and reaches the ammeter 115 close to the discrimination rollers 112. The surface resistance of the sheet S is calculated on the basis of measured current measured by the ammeter 115 and a voltage applied by the discrimination power supply 113, and the sheet type is discriminated.

Figure 4B:
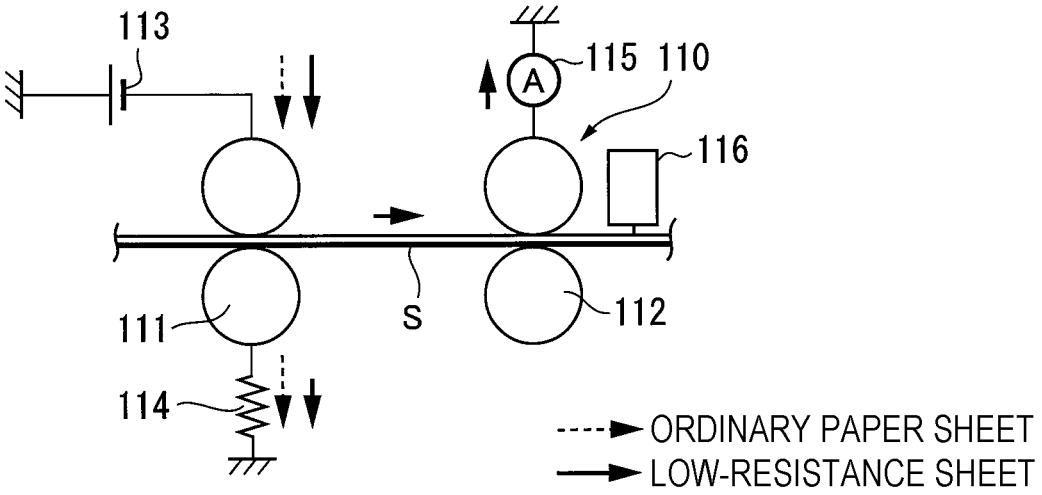
FIG. 4B is an explanatory diagram illustrating an example of a discrimination device illustrated in FIG. 3.

This example describes the aspect in which the discrimination device 110 discriminates the sheet type by measuring the surface resistance of the sheet S being transported. However, for example, when discrimination as the low-resistance sheet is difficult even in the metallic sheet or the black paper sheet when the method based on the surface resistance measurement is used, an optical sensor 116 based on light reflection may be installed as illustrated in FIG. 4B. The optical sensor 116 is capable of detecting light reflected from the surface of the sheet S. The sheet type may thereby be discriminated by performing comparison with the predetermined threshold level of the metallic sheet or the black paper sheet.

The configuration of the discrimination device 110 is not limited to this configuration. For example, the sheet type may be discriminated on the basis of a designation signal generated when a user designates the type of a used sheet.

Sheet Contact Members Upstream and Downstream of Second Transfer Region

In this exemplary embodiment, as illustrated in FIGS. 2 and 3, the guide chute 92 and the registration rollers 90 are disposed on the entrance side of the second transfer region TR, and the transport belt 85 that is disposed on the exit side of the second transfer region TR. These members serve as members in contact with the sheet S upstream and downstream of the second transfer region TR.

In this example, the registration rollers 90 include metal roller members, and the guide chute 92 includes metal chute members. The registration rollers 90 and the guide chute 92 are directly grounded.

Although the registration rollers 90 and the guide chute 92 are directly grounded in this example, the configuration is not limited to this configuration. A resistor grounding method by which grounding is performed via a resistor may be used. As long as the resistor used in the resistor grounding method has a resistance value lower than the resistance value (for example, a volume resistivity) of the component having the highest resistance (for example, the elastic transfer roller 55) of the components of the belt transfer module 51, any resistance value may be selected.

In addition, a transport belt 85 in this example includes a belt member 85*a* formed of, for example, conductive rubber that is stretched around paired tension rollers 85*b* and 85*c*. At least one of the tension rollers 85*b* and 85*c* includes a metal roller, conductive resin, or combination of these, and the cored bar thereof is directly grounded.

Further, in this exemplary embodiment, the guide chute 92 that is a member in contact with the sheet S and the transport belt 85 are located on the entrance side and the exit side of the second transfer region TR, respectively, and located just nearby the second transfer region TR. A sheet transport path length d between the guide chute 92 and the transport belt 85 is set shorter than a length ds, in the transport direction, of a sheet usable as a low-resistance sheet and having the smallest size among the sheets S. Accordingly, at least in the process of transport in which the sheet S (typically, the low-resistance sheet) passes through the second transfer region TR, the sheet S behaves in such a manner as to lie between the second transfer region TR and the guide chute 92 or between the second transfer region TR and the transport belt 85.

Relationship Between Sheet Type and Transfer Current Path

Non-Low-Resistance Sheet

Figure 5A:
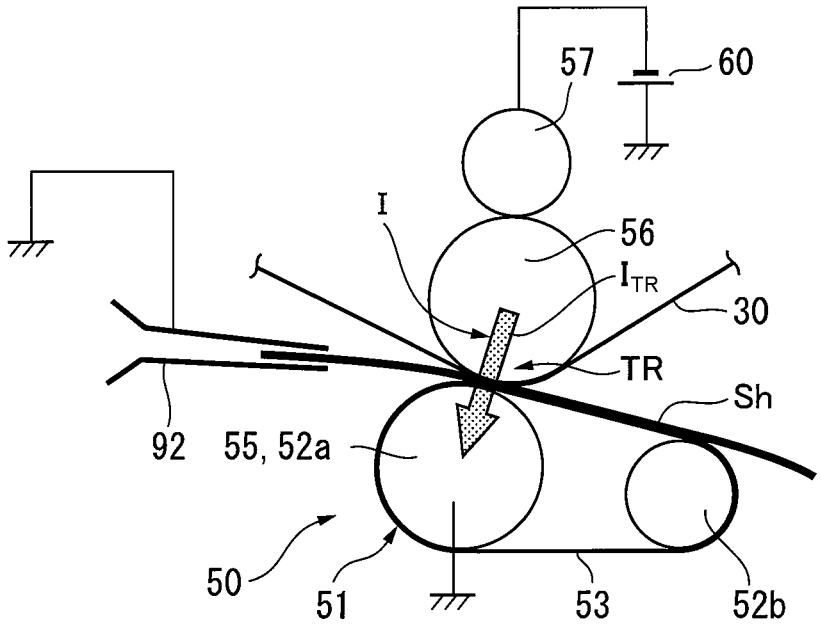
FIG. 5A is an explanatory diagram illustrating a path through which transfer current flows when a sheet other than the low-resistance sheet is used in the image forming apparatus according to Exemplary Embodiment 1.

Assume that a non-low-resistance sheet Sh enters the second transfer region TR. As illustrated in FIG. 5A, the non-low-resistance sheet Sh reaches the second transfer region TR via the guide chute 92. In the second transfer region TR, the image G on the intermediate transfer body 30 is transferred onto the non-low-resistance sheet Sh. Even if the non-low-resistance sheet Sh is in contact with the guide chute 92 while the non-low-resistance sheet Sh is passing through the second transfer region TR at this time, any of transfer current $I_{TR}$ in the second transfer region TR does not leak along the non-low-resistance sheet Sh serving as a current-carrying path to the current-carrying path to the ground via the guide chute 92 because the surface resistance of the non-low-resistance sheet Sh is high to some degree. The transfer current $I_{TR}$ for the second transfer region TR thus flows through the counter roller 56, the intermediate transfer body 30, the non-low-resistance sheet Sh, and the belt transfer module 51. Accordingly, the system resistance of the transfer current path (excluding the sheet) in this case is a total of the resistances of the counter roller 56, the intermediate transfer body 30, and the belt transfer module 51.

Low-Resistance Sheet

Figure 5B:
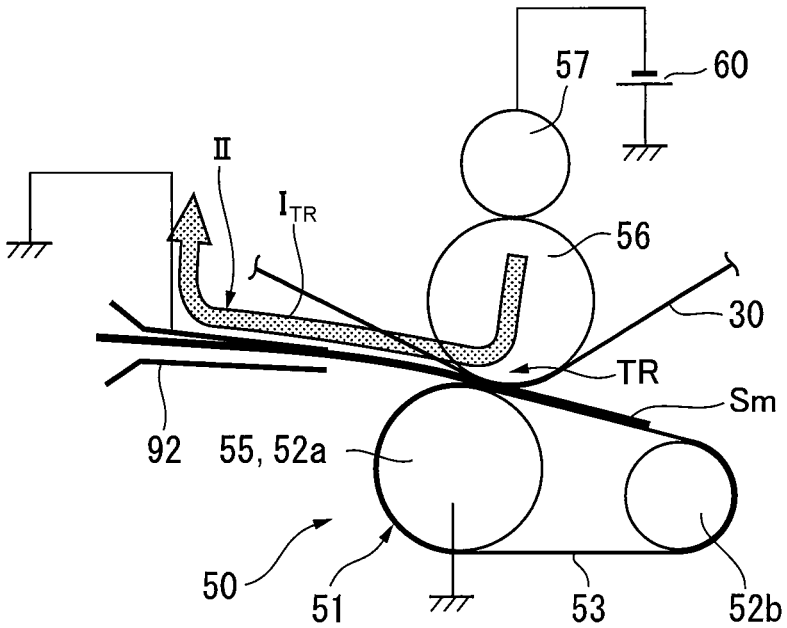
FIG. 5B is an explanatory diagram illustrating a path through which the transfer current flows when the low-resistance sheet is used in the image forming apparatus according to Exemplary Embodiment 1.

In contrast, assume that the low-resistance sheet Sm such as the metallic sheet or the black paper sheet enters the second transfer region TR. As illustrated in FIG. 5B, the low-resistance sheet Sm reaches the second transfer region TR via the guide chute 92. While the low-resistance sheet Sm is passing through the second transfer region TR, the low-resistance sheet Sm lies between the second transfer region TR and the guide chute 92 or lies between the second transfer region TR and the transport belt 85 (see FIG. 3) after the trailing edge of the low-resistance sheet Sm exits the guide chute 92. Since the low-resistance sheet Sm passing through the second transfer region TR remains in contact with at least one of the grounded guide chute 92 and the transport belt 85, the transfer current $I_{TR}$ for the second transfer region TR passes through the counter roller 56 and the intermediate transfer body 30 and thereafter flows along the low-resistance sheet Sm serving as the current-carrying path to the ground via the guide chute 92 (or the transport belt 85). Since the guide chute 92 or the transport belt 85 has a low resistance value, the system resistance of the transfer current path (excluding the sheet) in this case is typically a total of the resistances of the counter roller 56 and the intermediate transfer body 30.

Figure 7A:
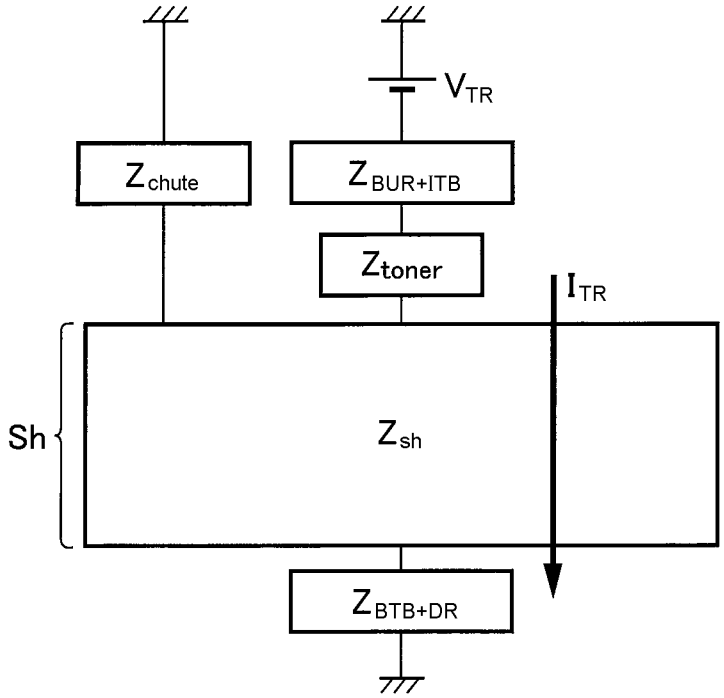
FIG. 7A is an explanatory diagram schematically illustrating the process of the transfer operation performed on the sheet other than the low-resistance sheet in the second transfer unit according to Exemplary Embodiment 1.
Figure 7B:
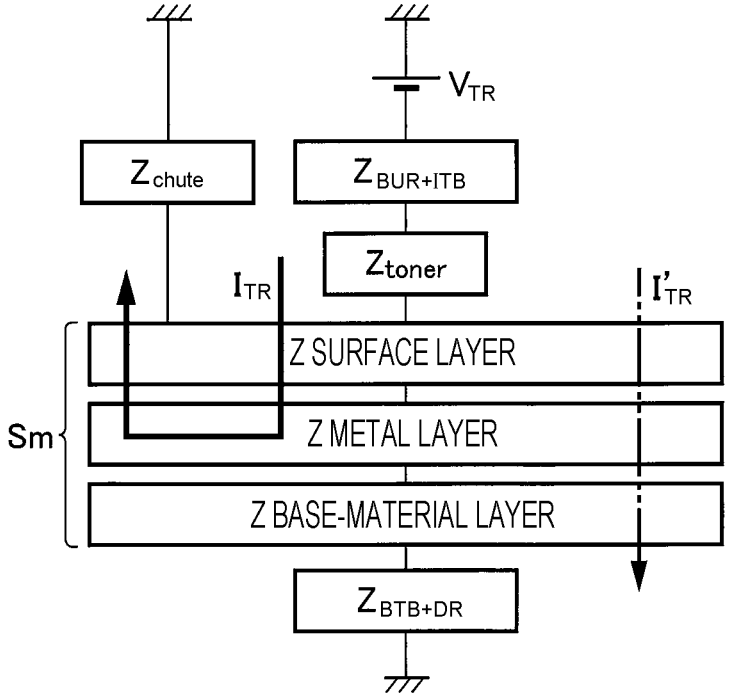
FIG. 7B is an explanatory diagram schematically illustrating the process of the transfer operation performed on the low-resistance sheet in the second transfer unit according to Exemplary Embodiment 1.

FIGS. 7A and 7B schematically illustrate respective equivalent circuits, with the impedances of components around the second transfer region TR in this exemplary embodiment being defined as follows.

$Z_{BUR+ITB}$: the impedance of the counter roller 56+the intermediate transfer body 30

$Z_{BTB+DR}$: the impedance of the belt transfer module 51 (transfer and transport belt 53+the elastic transfer roller 55)

$Z_{toner}$: the impedance of toner $Z_{Sh}$: the impedance of the non-low-resistance sheet Sh Z base-material layer: the impedance of the base-material layer 100 of the low-resistance sheet Sm Z metal layer: the impedance of the metal layer 101 of the low-resistance sheet Sm Z surface layer: the impedance of the surface layer 102 of the low-resistance sheet Sm $Z_{chute}$: the impedance of the guide chute 92

In FIGS. 7A and 7B, reference $V_{TR}$ and $I_{TR}$ respectively denote a transfer voltage and transfer current.

Assume that the transfer voltage $V_{TR}$ is applied to the second transfer region TR in each equivalent circuit illustrated in FIGS. 7A and 7B. Regarding the non-low-resistance sheet Sh, the transfer current $I_{TR}$ flows to the belt transfer module 51 as illustrated in FIG. 7A. The current value of the transfer current $I_{TR}$ is determined on the basis of the transfer voltage $V_{TR}$ and the above-described system resistance, specifically the impedance of the counter roller 56 and the intermediate transfer body 30 ($Z_{BUR+ITB}$), and the impedance $Z_{BTB+DR}$ of the belt transfer module 51.

In contrast, regarding the low-resistance sheet Sm, the transfer current $I_{TR}$ does not flow to the belt transfer module 51. As illustrated in FIG. 7B, the transfer current $I_{TR}$ flows through the metal layer 101 (see FIG. 4A) of the low-resistance sheet Sm serving as the current-carrying path and flows to, for example, the path to the ground via the guide chute 92. The current value of the transfer current $I_{TR}$ is determined on the basis of the transfer voltage $V_{TR}$ and the above-described system resistance, specifically the impedance of the counter roller 56 and the intermediate transfer body 30 ($Z_{BUR+ITB}$).

Transfer Voltage Control Method

A transfer voltage control method includes a constant voltage control method and a constant current control method.

The constant voltage control method has characteristics of robustness (corresponding to resistance to disturbance) in an area coverage change but weakness in a sheet type change. The constant current control method has characteristics of robustness in a sheet type change but weakness in an area coverage change. In this example, the constant voltage control method is employed because the sheet type change may be addressed by preparing a transfer voltage table in advance.

Figure 6A:
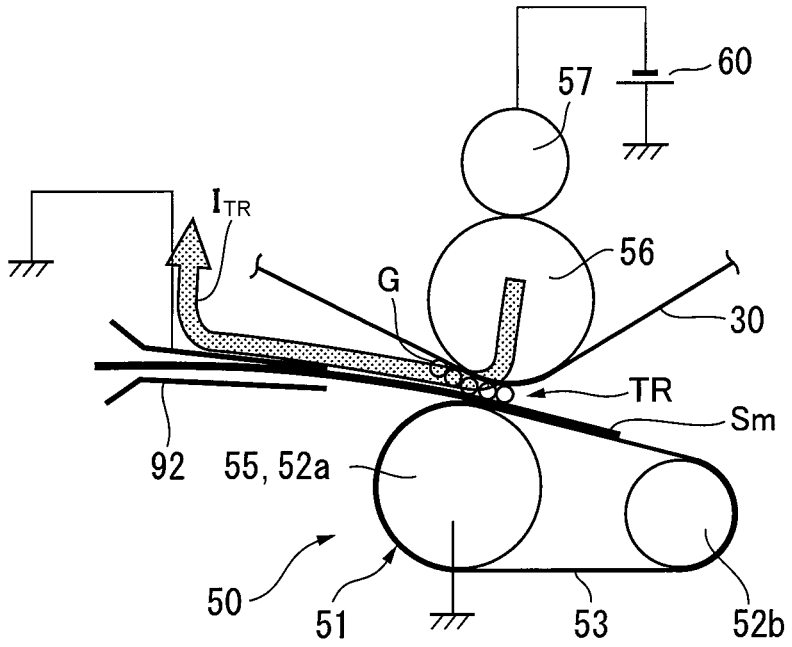
FIG. 6A is an explanatory diagram illustrating that a transfer operation through the transfer current path illustrated in FIG. 5B may be performed.

In this example, as illustrated in FIG. 6A, the transfer power supply 60 is connected on the counter roller 56 side, and thus the transfer current $I_{TR}$ flows along the low-resistance sheet Sm from the intermediate transfer body 30 and then flows to the ground via the contact member such as the guide chute 92. Since a transfer electric field is generated between the intermediate transfer body 30 and the low-resistance sheet Sm, the image G formed by using the toner on the intermediate transfer body 30 is transferred on the low-resistance sheet Sm.

Figure 6B:
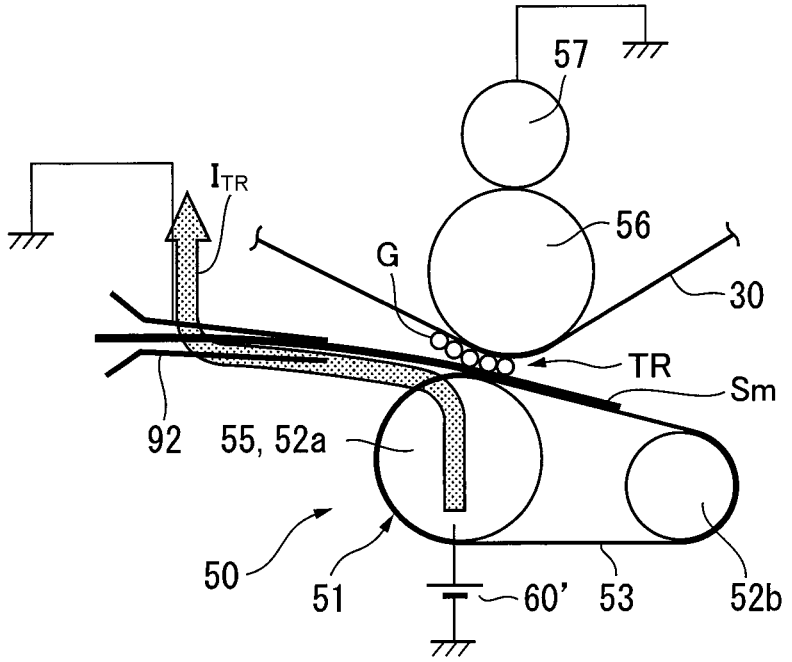
FIG. 6B is an explanatory diagram illustrating that it is not possible for a second transfer unit according to a comparative exemplary embodiment to perform the transfer operation.

However, if a transfer power supply 60' is connected on the belt transfer module 51 side as illustrated in FIG. 6B, the transfer current $I_{TR}$ flows from the intermediate transfer body 30 via the low-resistance sheet Sm to the contact member such as the guide chute 92 and then to the ground. Since a transfer electric field does not act on the part between the intermediate transfer body 30 and the low-resistance sheet Sm, the image G formed by using the toner on the intermediate transfer body 30 is not transferred on the low-resistance sheet Sm. That is, the transfer power supply 60 needs to be connected on the counter roller 56 side to apply the transfer voltage $V_{TR}$.

System Resistance Detection Circuit

In this exemplary embodiment, a first-resistance detection circuit 130 and a second-resistance detection circuit 140 are provided, with the attention being focused on the change of a transfer current path depending on the sheet type. The first-resistance detection circuit 130 detects the system resistance of the transfer current path at the time of using the non-low-resistance sheet Sh as illustrated in FIGS. 3 and 5A. The second-resistance detection circuit 140 detects the system resistance of the transfer current path at the time of using the low-resistance sheet Sm as illustrated in FIGS. 3 and 5B.

In this example, as illustrated in FIG. 3, the first-resistance detection circuit 130 includes a first ammeter 131 that is located between the elastic transfer roller 55 of the belt transfer module 51 and the ground and that is connected in series with the elastic transfer roller 55 and the ground. The first-resistance detection circuit 130 calculates a current value dependent on the above-described system resistance.

The second-resistance detection circuit 140 includes a second ammeter 141 that is located between the counter roller 56 and the ground and that is connected in series with the counter roller 56 and the ground via a switch 142, as illustrated in FIG. 3. With the belt transfer module 51 being retracted from the intermediate transfer body 30 by the retraction mechanism 65, the second-resistance detection circuit 140 switches the switch 142 on and calculates a current value dependent on the above-described system resistance (typically the resistance of the counter roller 56 in this example) by using the second ammeter 141. In this example, a method in which the counter roller 56 is directly grounded and the resistance of the counter roller 56 is detected as the system resistance is employed. Originally, the system resistance including the resistance of the counter roller 56 and the intermediate transfer body 30 may be directly measured; however, measuring the resistance of only the counter roller 56 may enable prediction of the system resistance of the transfer current path because the intermediate transfer body 30 has a slight resistance change over time.

Driving Control System of Image Forming Apparatus

In this exemplary embodiment, as illustrated in FIG. 3, reference numeral 120 denotes a controller that controls the imaging process of the image forming apparatus. The controller 120 is composed of a microcomputer including a central processing unit (CPU), a read-only memory (ROM), a random-access memory (RAM), and an input/output interface. The controller 120 is configured as follows. Via the input/output interface, the controller 120 takes in switching signals from the start switch, a mode selection switch that selects an imaging mode, and other switches (each of which is not illustrated), various sensor signals from the first-resistance detection circuit 130, the second-resistance detection circuit 140, and other components, and further various input signals such as a sheet discrimination signal from the discrimination device 110 that discriminates the sheet type. The controller 120 causes the CPU to run an imaging control program (see FIG. 8) stored in the ROM in advance. The controller 120 generates control signals for driving control targets and thereafter transmits each control signal to the corresponding driving control target (such as the transfer power supply 60).

Operation of Image Forming Apparatus

Figure 8:
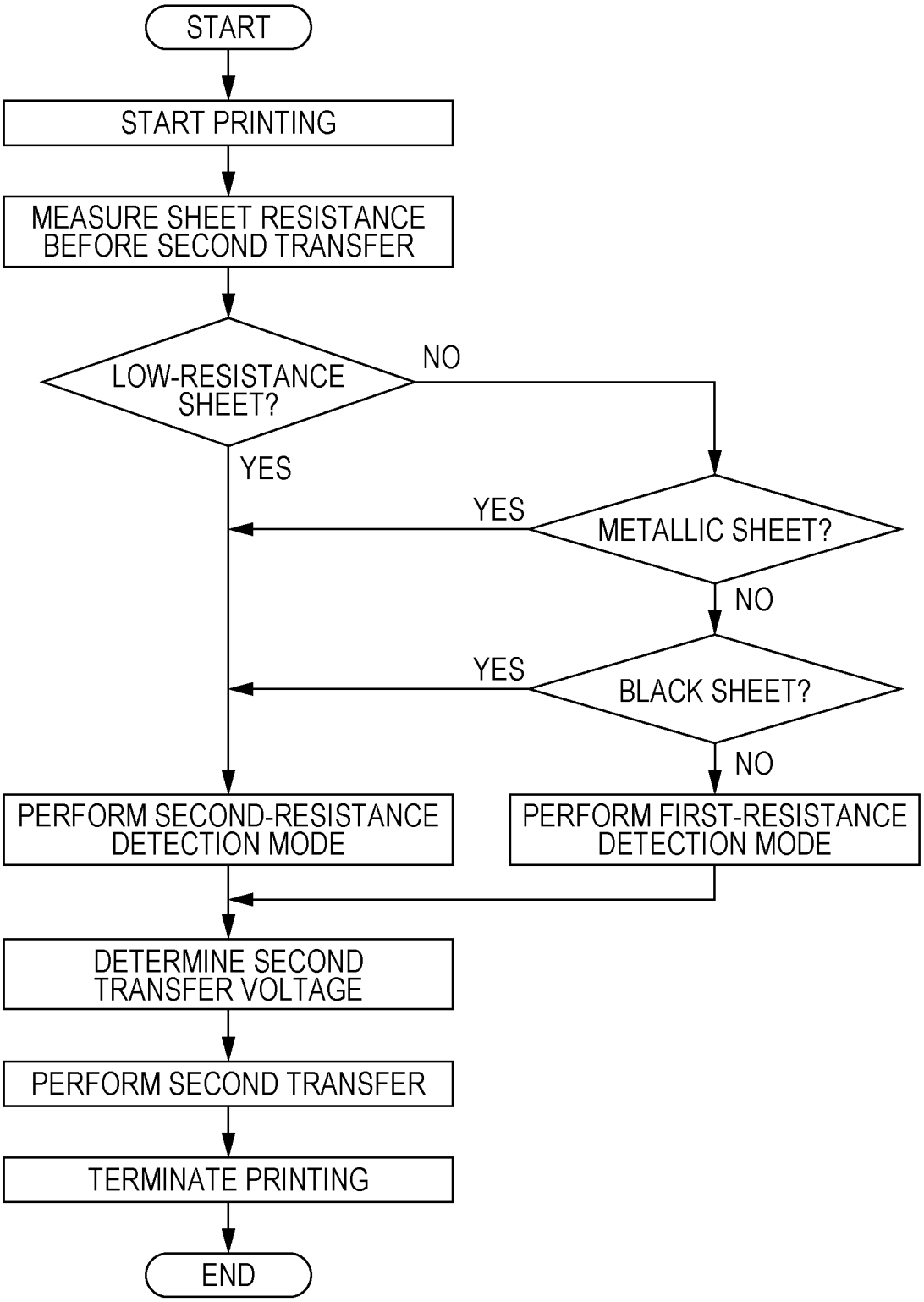
FIG. 8 is an explanatory flowchart illustrating a sheet-type dependent imaging sequence used for the image forming apparatus according to Exemplary Embodiment 1.

Assume that the sheets S of different types are mixed and used in the image forming apparatus illustrated in FIGS. 2 and 3. As illustrated in FIG. 8, the start switch (not illustrated) is turned on, and printing (the imaging process) by the image forming apparatus is thereby started.

At this time, a sheet S is supplied from one of the sheet supply containers 81 and 82 and the manual sheet feeder 95 and is transported toward the second transfer region TR via the predetermined transport path. In the course of the transportation to the second transfer region TR, the discrimination device 110 executes a process for discriminating a sheet type. In this example, a discrimination process for discriminating whether the sheet S is a low-resistance sheet with a surface resistance of 8 log Ω or lower is first executed. If the sheet S is not a low-resistance sheet with the surface resistance of 8 log Ω or lower, but if the sheet S is a metallic sheet or a black paper sheet, the sheet S is discriminated as a low-resistance sheet.

If the sheet S is discriminated as a non-low-resistance sheet Sh after the sheet type discrimination process is executed, a first-resistance detection mode (corresponding to an operation for detecting first system resistance) is performed. If the sheet S is discriminated as a low-resistance sheet Sm, a second-resistance detection mode (corresponding to an operation for detecting second system resistance) is performed, and thereafter a second transfer voltage is determined on the basis of the detected system resistance. The details thereof will be described later.

When the sheet S thereafter reaches the second transfer region TR, the image G formed by the image forming units 22 (22*a* to 22*f*) and having undergone the first transfer on the intermediate transfer body 30 undergoes the second transfer on the sheet S. The sheet S undergoes the fixing process by the fixing device 70 and exits into the sheet exit tray 86. Then, a series of printing steps (imaging process) is terminated.

First-Resistance Detection Mode

Figure 9A:
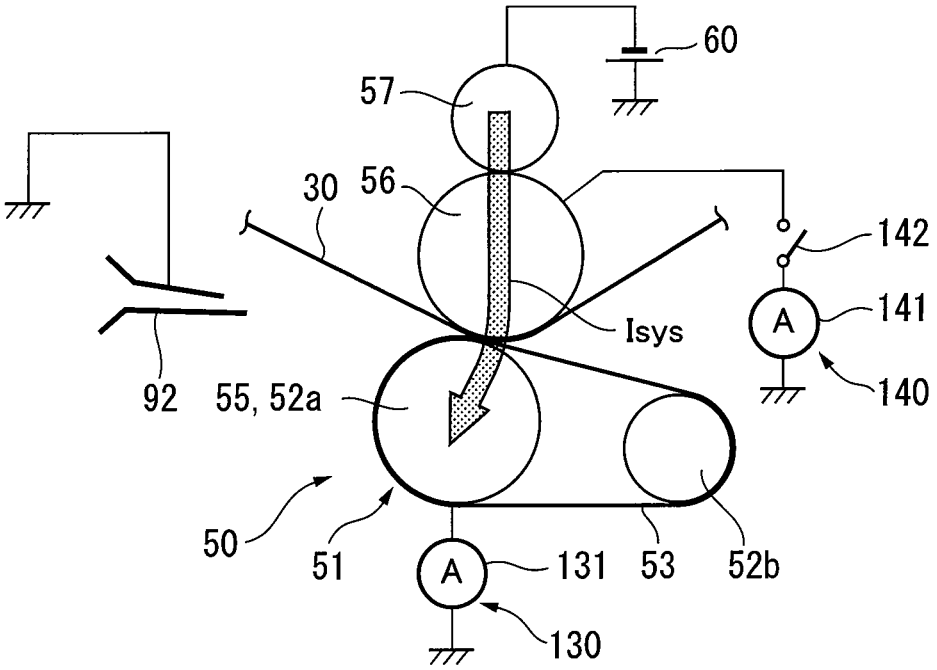
FIG. 9A is an explanatory diagram illustrating an example operation for detecting first system resistance used in the image forming apparatus according to Exemplary Embodiment 1.

If the sheet S is discriminated as the non-low-resistance sheet Sh as the result of the sheet type discrimination process, the first-resistance detection mode is performed, and the first-resistance detection circuit 130 detects the first system resistance, as illustrated in FIG. 9A. Since the first system resistance is determined on the basis of the resistance value of the counter roller 56, the intermediate transfer body 30, and the belt transfer module 51 in this example, the controller 120 flows a constant current Isys for system resistance detection to the first ammeter 131, with the belt transfer module 51 being in contact with the intermediate transfer body 30. The controller 120 calculates the first system resistance on the basis of the voltage value at this time and determines the second transfer voltage by using a coefficient for the sheet type (basis weight/size).

Second-Resistance Detection Mode

Figure 9B:
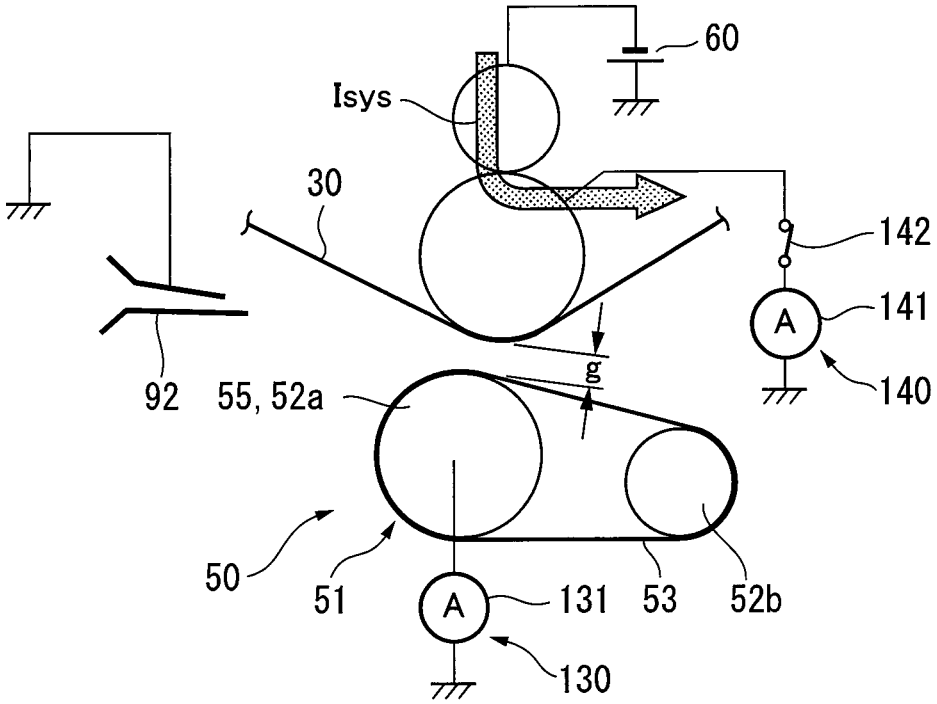
FIG. 9B is an explanatory diagram illustrating an operation example for detecting second system resistance used in the image forming apparatus according to Exemplary Embodiment 1.

In contrast, if the sheet S is discriminated as the low-resistance sheet Sm, the second-resistance detection mode is performed, and the second-resistance detection circuit 140 detects the second system resistance, as illustrated in FIG. 9B. In this case, the second system resistance is determined on the basis of the resistance value of the counter roller 56 and the intermediate transfer body 30, and the belt transfer module 51 does not contribute to the transfer. Accordingly, the use of the second transfer voltage determined on the basis of the first system resistance does not enable estimation of an appropriate second transfer voltage. Hence in this example, the controller 120 causes the retraction mechanism 65 to retract the belt transfer module 51 from the position of contact with the intermediate transfer body 30, switches the switch 142 on, and thereby causes the counter roller 56 to be grounded. In this state, the controller 120 flows the constant current Isys for system resistance detection to the second ammeter 141, calculates the second system resistance on the basis of the voltage value at this time, and determines the second transfer voltage by using a coefficient for the sheet type (basis weight/size). Although the second ammeter 141 measures the resistance of only the counter roller 56 in this example, the second system resistance that is a total of the resistances of the counter roller 56 and the intermediate transfer body 30 may be predicted by using predetermined data provided as the resistance of the intermediate transfer body 30 because the intermediate transfer body 30 has a slight resistance change over time. This enables an appropriate second transfer voltage to be estimated.

In addition, when the second system resistance is detected, the belt transfer module 51 is retracted from the position of contact with the intermediate transfer body 30 in this example. However, a gap g between the belt transfer module 51 and the intermediate transfer body 30 is preferably set at a value higher than or equal to a value obtained by dividing the maximum voltage value (kV) of the transfer power supply 60 by 3 (mm). The gap g with a value lower than this value is likely to cause discharging in accordance with Paschen's law at the time of detecting the second system resistance and thus cause damage to the belt transfer module 51 and the intermediate transfer body 30. A specific example of setting the gap g in the second system resistance detection will be described in detail in Example 4 described later.

In contrast, for the non-low-resistance sheet Sh, the use of the second system resistance detected by the second-resistance detection circuit 140 does not enable estimation of an appropriate second transfer voltage, and thus the first-resistance detection circuit 130 or the second-resistance detection circuit 140 needs to be selected on the basis of the transfer current path, that is, the sheet type (the non-low-resistance sheet Sh or the low-resistance sheet Sm).

Second Transfer Voltage Determination Method

A method for determining a second transfer voltage from a system resistance detection result will be described.

First, a regression equation for estimating a second transfer voltage from a system resistance detection result.

Figure 10A:
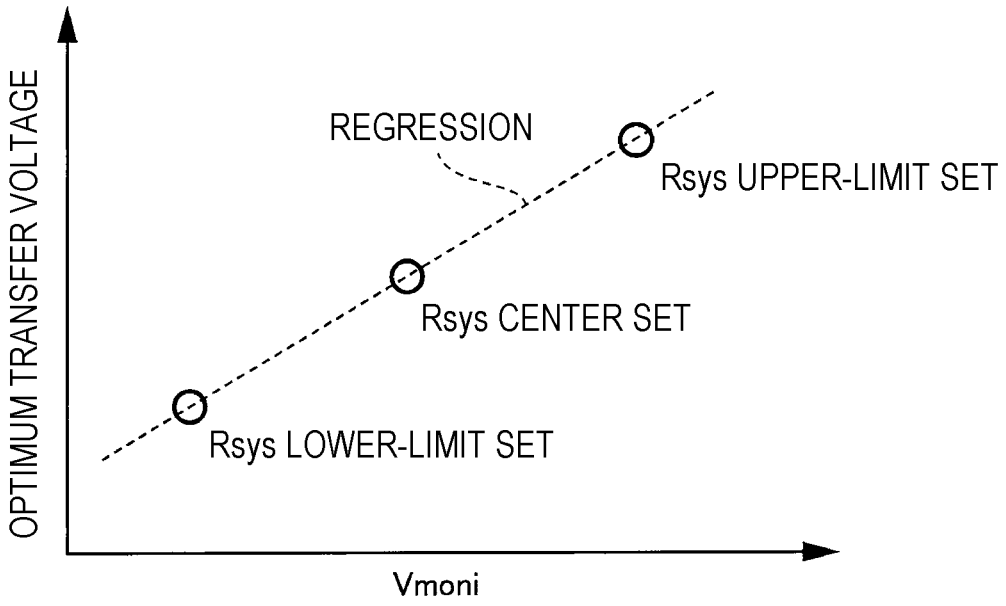
FIG. 10A is an explanatory graph illustrating a regression determination method for estimating a transfer voltage (second transfer voltage) from a system resistance detection result.

Since the optimum transfer voltage is proportional to the system resistance (Rsys) of a transfer current path I or II in the corresponding first or second system resistance, an optimum transfer voltage for each of the following three sets (each expressed by a voltage value Vmoni observed when constant current is caused to flow to a corresponding one of the first ammeter 131 and the second ammeter 141 in this example) is experimentally obtained. The three sets are a system-resistance upper-limit set (the transfer current path I; the upper limit of BUR (corresponding to the counter roller)/the upper limit of BTB (corresponding to the belt transfer module) and the transfer current path II; the upper limit of BUR), a system-resistance center set (the transfer current path I; the center of BUR/the center of BTB and the transfer current path II; the center of BUR), and a system-resistance lower-limit set (the transfer current path I; the lower limit of BUR/the lower limit of BTB and the transfer current path II; the lower limit of BUR). As illustrated in FIG. 10A, the linear regression is determined on the basis of the experimentally obtained data, and the optimum transfer voltage is thereby estimated.

The optimum transfer voltage value obtained experimentally denotes a center value in a range in which the desired values of white coverage (corresponding to the white brightness) and white+blue density (corresponding to the M density: magenta density) are both achieved. In this example, whether the transferrability of a white+blue image is good or bad is determined on the basis of of an amount of magenta toner, that is, magenta density (M density), in consideration of transfer difficulty. Since the white+blue image is formed in the order of white, cyan, and magenta on the sheet surface, the magenta toner farthest from the sheet surface is most difficult to transfer.

Figure 10B:
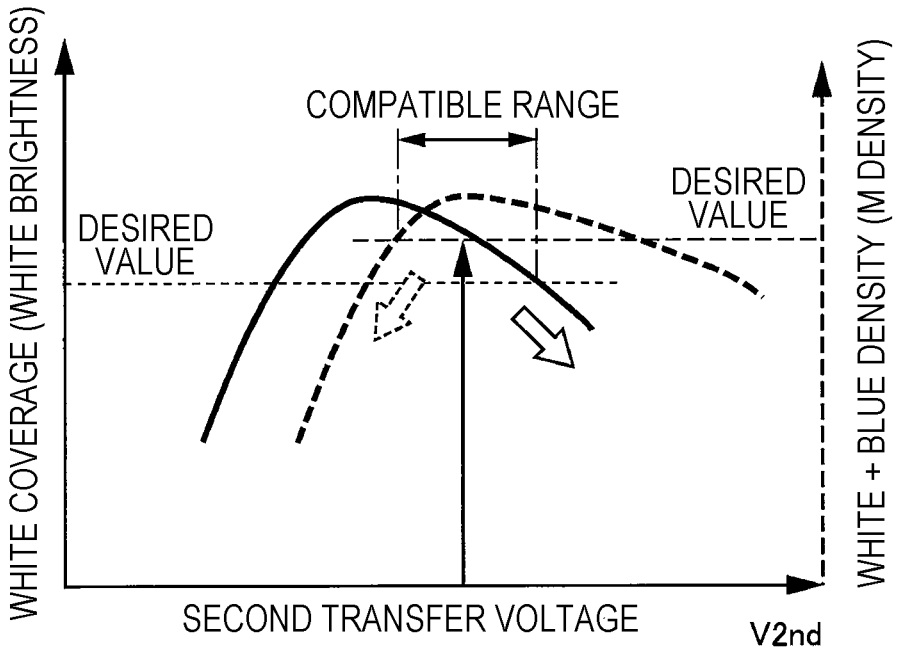
FIG. 10B is an explanatory graph illustrating an idea for setting the transfer voltage.

As illustrated in FIG. 10B, a single color (white) and a multiple-color (white+blue) have respective different total toner charge amounts, and thus the peaks of the white coverage (white brightness) and the white+blue density (M density) represent respective different second transfer voltages V2nd due to its mechanism. Normally, setting of a second transfer voltage V2nd is performed to ensure the desired multiple-color (white+blue) density. That is, the white coverage (white brightness) is set to achieve a desired value but set below the peak. A too low second transfer voltage V2nd causes the multiple-color (white+blue) density to fall below the desired value, and a too high second transfer voltage V2nd causes the white coverage (white brightness) to fall below the desired value.

Modification 1

The second-resistance detection circuit 140 is configured to detect the resistance of only the counter roller 56 in this exemplary embodiment, but the configuration is not limited to this configuration. As in Modification 1 illustrated in FIG. 11B, the resistance of the counter roller 56 and the intermediate transfer body 30 may be detected.

In this example, the first-resistance detection circuit 130 is the same as that in Exemplary Embodiment 1. However, in the second-resistance detection circuit 140, a second ammeter 143 is located between the guide chute 92 and the ground and is connected in series with the guide chute 92 and the ground. As illustrated in FIG. 11B, a conductive sheet 144 for resistance detection is transported, and thereby the intermediate transfer body 30 and the guide chute 92 are caused to conduct via the conductive sheet 144. The constant current Isys for system resistance detection is caused to flow to the second ammeter 143, the second system resistance is calculated on the basis of the voltage value at this time, and the second transfer voltage is determined by using a coefficient for the sheet type (basis weight/size).

In this case, even if the intermediate transfer body 30 and the belt transfer module 51 are arranged in contact with each other, the current flows along the conductive sheet 144, and thus retracting the belt transfer module 51 from the position of contact with the intermediate transfer body 30 is not necessarily needed. A sheet usable specially for the second system resistance detection may be used as the conductive sheet 144 for resistance detection; however, it goes without saying that the low-resistance sheet Sm (including the metallic sheet and the black paper sheet) actually used for printing may be used.

Figure 11A:
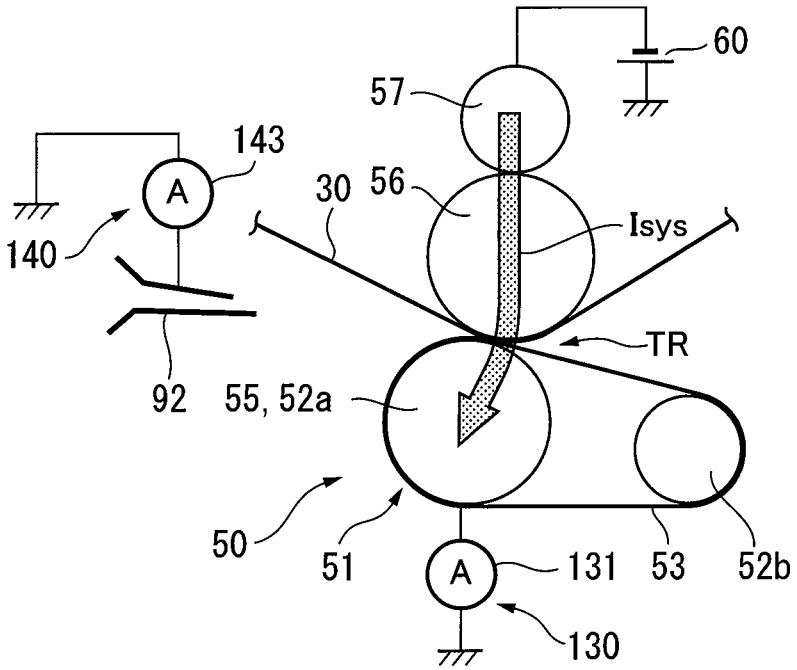
FIG. 11A is an explanatory diagram illustrating an example operation in a first-resistance detection mode used in an image forming apparatus according to Modification 1.
Figure 11B:
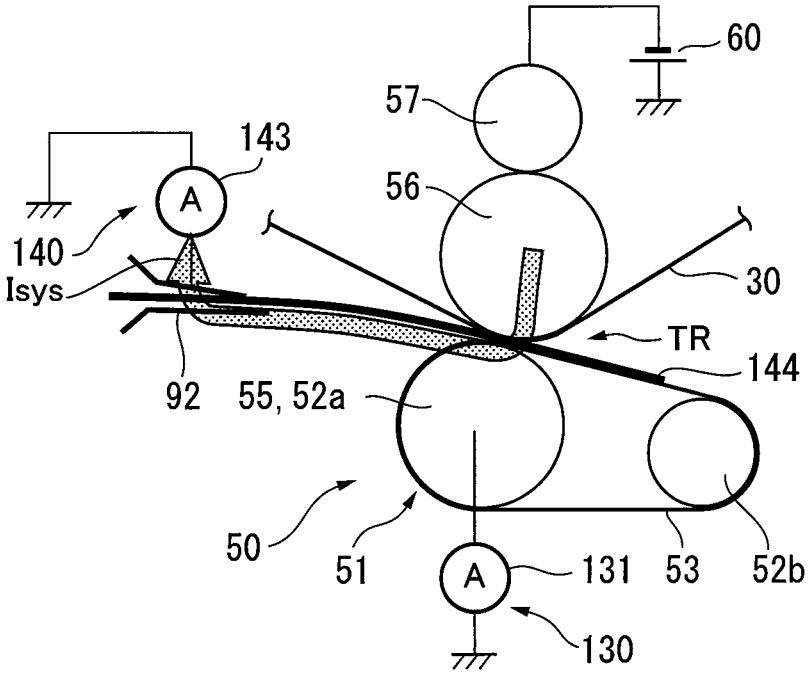
FIG. 11B is an explanatory diagram illustrating an example operation in a second-resistance detection mode used in the image forming apparatus according to Modification 1.

To detect the first system resistance, as illustrated in FIG. 11A, the constant current Isys for system resistance detection is caused to flow to the first ammeter 131 of the first-resistance detection circuit 130, and the system resistance may be calculated on the basis of the voltage value at this time.

EXAMPLES

Example 1

In Example 1, the image forming apparatus according to Exemplary Embodiment 1 is embodied, and an image forming apparatus based on the Color 1000 Press by Fuji Xerox Co., Ltd. is used. Evaluation environments are as follows. The temperature/humidity is 20° C./10%, and the process speed is 524 mm/sec. As the toner, each of CMY has a specific gravity of 1.1 and an average particle diameter of 4.7 μm, K has a specific gravity of 1.2 and an average particle diameter of 4.7 μm, and white has a specific gravity of 1.6 and an average particle diameter of 8.5 μm. A toner charge amount of 53 μC/g is set for each of CMY, and toner charge amounts of 58 μC/g and 27 μC/g are respectively set for K and white. As toner mass per area (TMA), 3.8 g/m$^2$ is set for each of CMY, and 3.7 g/m$^2$ and 8.2 g/m$^2$ are respectively set for K and white. As the first transfer device 27, a ϕ28 elastic roller with a resistance of 7.7 log Ω and Asker C hardness of 30° is used. First transfer current is set at 54 μA. The intermediate transfer body 30 containing carbon distributed in polyimide and having a volume resistivity of 12.5 log Ωcm is used. In the second transfer device 50, the belt transfer module 51 including the ϕ28 elastic transfer roller 55 (corresponding to the tension roller 52*a*) with a resistance of 6.31 log Ω, a ϕ40 rubber belt (corresponding to the transfer and transport belt 53), and a ϕ20 separation roller (corresponding to the tension roller 52*b*) is used. The elastic transfer roller 55 is covered with the ϕ40 rubber belt in a thickness of 450 μm and with each of three levels of volume resistivities of 8.5 log Ω, 9.2 log Ω, and 10.0 log Ω, and the rubber belt is stretched around the elastic transfer roller 55 and the separation roller. As the counter roller 56, a ϕ28 elastic roller with Asker C hardness of 53° and with each of three levels of the surface resistances of 7.0 log Ω/sq, 7.3 log Ω/sq, and 7.6 log Ω/sq is used, with the intermediate transfer body 30 placed between the counter roller 56 and the elastic transfer roller 55. To arrange the image forming units 22 (specifically, 22*a* to 22*f*), image forming units that form images by using toner of color components of white/C/M/Y/K/white are used.

An optimum transfer voltage for Vmoni (a voltage needed for supplying constant current of 120 μA to the ammeter in this example) for the system resistance is set by using each of the conditions with Level Nos. (1) to (9) in FIG. 13 on the basis of the detection results of the respective first-resistance and second-resistance detection modes performed for outputting a solid image of an A3 borderless printing size in each of white and white+blue to be output on a high quality color paper (black) sheet of 124 grams per square meter (gsm) and of an A3 size (a surface resistance of 5.3 log Ω) by Hokuetsu Kishu Paper Co., Ltd. The solid image is then output.

According to FIG. 13, when each solid image is output with the second transfer voltage set on the basis of the regression equation in the first-resistance detection mode, both the desired white coverage (white brightness) and the desired white+blue density are achieved only in the above-described three cases (Level Nos. (1), (5), and (9) in this example) as illustrated in FIG. 12A.

Figure 12A:
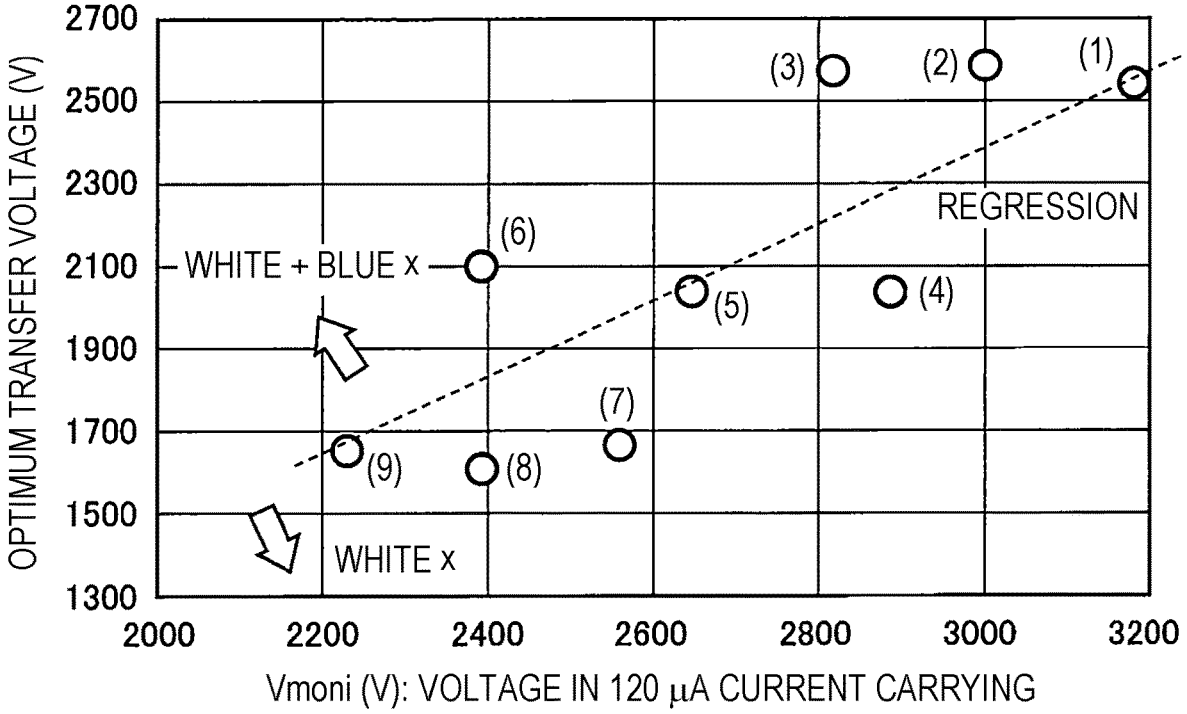
FIG. 12A is an explanatory graph illustrating a relationship between a regression equation and an optimum transfer voltage in the first-resistance detection mode of an image forming apparatus according to Example 1.

FIG. 12A illustrates a relationship between the regression equation in the first-resistance detection mode and the actual optimum transfer voltage searched for by changing the transfer voltage without using the regression equation. Under the conditions in which the actual optimum transfer voltage is located above the regression equation (Level Nos. (2), (3), and (6) in this example), the density of the multiple-color (white+blue) is short due to an insufficient transfer voltage. Under the conditions in which the actual optimum transfer voltage is located below the above-described regression equation (Level Nos. (4), (7), and (8) in this example), the white coverage (white brightness) is short due to an excessive transfer voltage. Accordingly, in the first-resistance detection mode, it is not possible to set an appropriate second transfer voltage against resistance variation among the members included in the second transfer device 50. This is because the system resistance detected in the first-resistance detection mode is not the system resistance of the transfer current path to be actually used.

Figure 12B:
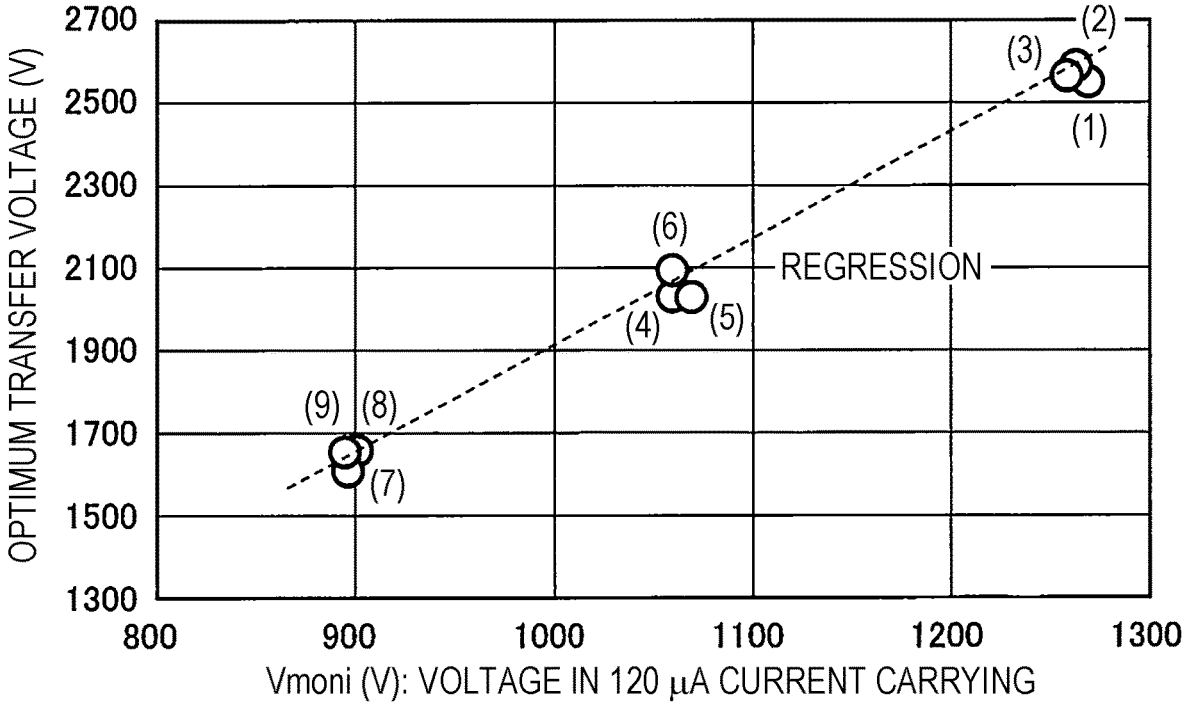
FIG. 12B is an explanatory graph illustrating a relationship between a regression equation and an optimum transfer voltage in the second-resistance detection mode of the image forming apparatus according to Example 1.

In contrast, when each solid image is output with the second transfer voltage set on the basis of the regression equation for the second-resistance detection mode, it is confirmed that both the desired white coverage (white brightness) and the desired white+blue density are achieved in all of the cases (Level Nos. (1) to (9) in this example). FIG. 12B illustrates a relationship between the regression equation in the second-resistance detection mode and the actual optimum transfer voltage searched for by changing the transfer voltage without using the regression equation. In all of the cases, the second transfer voltage set on the basis of the regression equation coincides with the actual optimum transfer voltage. This suggests that the system resistance detected in the second-resistance detection mode coincides with the system resistance of the transfer current path.

Example 2

In Example 2, experiments in the same environments as in Example 1 are performed on the following sheet in the same configuration of the image forming apparatus according to Example 1.

Specifically, an optimum transfer voltage for Vmoni (a voltage needed for supplying constant current of 120 μA to the ammeter in this example) for the system resistance is set by using each of conditions with Level Nos. (1) to (9) in FIG. 15 on the basis of the detection results of the respective first-resistance and second-resistance detection modes performed for outputting a solid image of an A3 borderless printing size in each of white and white+blue to be output on an jet-black Ten color card of 256 gsm and of an A3 size (a surface resistance of 13.1 log Ω) by Ohji F-Tex Co., Ltd. The solid image is then output.

In addition, the linear regression as the regression equation is determined in the same manner as in Example 1.

According to FIG. 15, when each solid image is output with the second transfer voltage set on the basis of the regression equation in the first-resistance detection mode, it is confirmed that both the desired white coverage (white brightness) and the desired white+blue density are achieved in all of the cases (Level Nos. (1) to (9)).

Figure 14A:
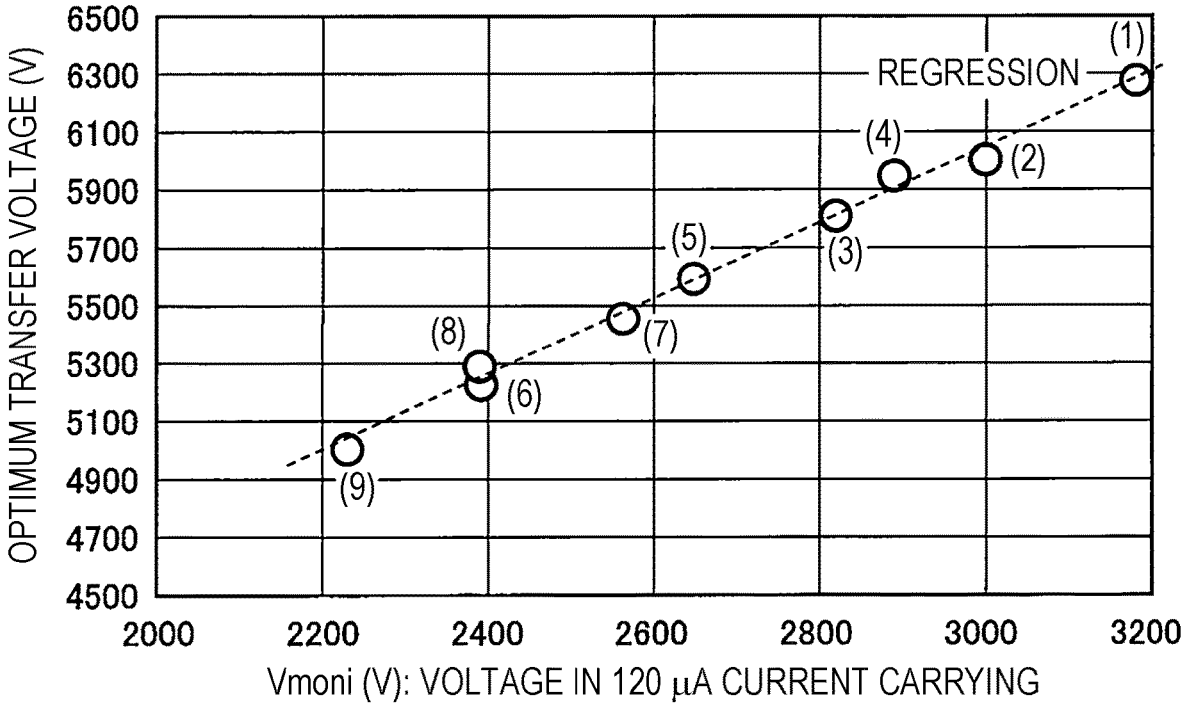
FIG. 14A is an explanatory graph illustrating a relationship between a regression equation and an optimum transfer voltage in the first-resistance detection mode of an image forming apparatus according to Example 2.

In this example, FIG. 14A illustrates a relationship between the regression equation in the first-resistance detection mode and the actual optimum transfer voltage searched for by changing the transfer voltage without using the regression equation. In all of the cases, the second transfer voltage set on the basis of the regression equation coincides with the actual optimum transfer voltage. This suggests that the system resistance detected in the first-resistance detection mode coincides with the system resistance of the transfer current path.

Figure 14B:
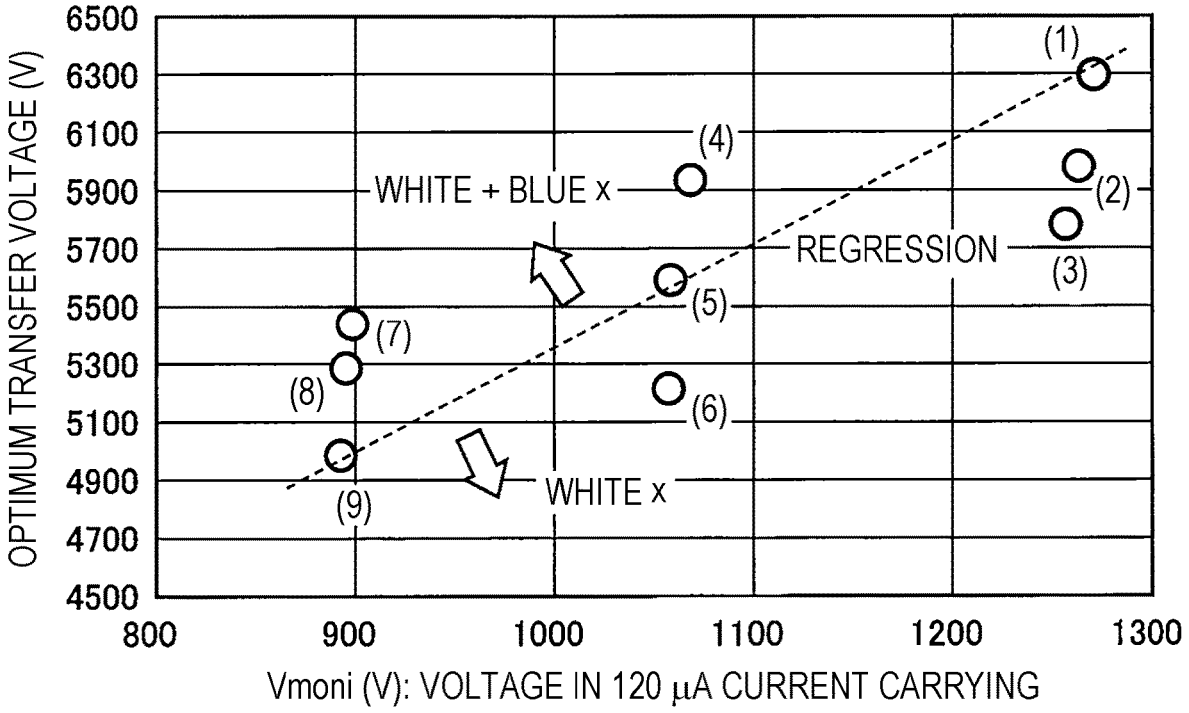
FIG. 14B is an explanatory graph illustrating a relationship between a regression equation and an optimum transfer voltage in the second-resistance detection mode of the image forming apparatus according to Example 2.

In contrast, when each solid image is output with the second transfer voltage set on the basis of the regression equation in the second-resistance detection mode, both the desired white coverage (white brightness) and the desired white+blue density are achieved only in the above-described three cases (Level Nos. (1), (5), and (9) in this example). FIG. 14B illustrates a relationship between the regression equation in the second-resistance detection mode and the actual optimum transfer voltage searched for by changing the transfer voltage without using the regression equation. Under the conditions in which the actual optimum transfer voltage is located above the regression equation (Level Nos. (4), (7), and (8) in this example), the density of the multiple-color (white+blue) is short due to insufficient transfer voltage. Under the conditions in which the actual optimum transfer voltage is located below the above-described regression equation (Level Nos. (2), (3), and (6) in this example), the white coverage (white brightness) is short due to an excessive transfer voltage. Accordingly, in the second-resistance detection mode, it is not possible to set an appropriate second transfer voltage against resistance variation among the members included in the second transfer device 50. This is because the system resistance detected in the second-resistance detection mode is not the system resistance of the transfer current path.

As described above, according to Examples 1 and 2, switching between the first-resistance detection mode and the second-resistance detection mode is performed depending on the sheet type (for example, the surface resistance). A good quality of both the white coverage (white brightness) and the multiple-color (white+blue) density may thereby be achieved for each sheet type.

Example 3

In Example 3, experiments in the same environments as in Example 2 are performed on the following sheet in the same configuration of the image forming apparatus according to Example 2.

Specifically, the moisture of the jet-black Ten color card of 256 gsm and of an A3 size by Ohji F-Tex Co., Ltd. is controlled in the environment chamber, and states in changed resistances are produced. Whether both the desired white coverage (white brightness) and the desired multiple-color (white+blue) density are achieved is studied in each of the first-resistance detection mode and the second-resistance detection mode.

In this example, as a combination of resistances of members included in the second transfer device 50, Level No. (3) and Level No. (7) are used. With Level No. (3) and Level No. (7), the optimum transfer voltages are respectively higher and lower than the corresponding regression equation value in the second-resistance detection mode in Example 2.

FIG. 16 illustrates the results.

From FIG. 16, it is understood that the second-resistance detection mode is preferably used for a sheet with a resistance of 8.0 log Ω or lower. This suggests transfer on the sheet with the resistance of 8.0 log Ω or lower through the transfer current path II.

Example 4

In Example 4, the second transfer unit of the image forming apparatus according to Exemplary Embodiment 1 is embodied, and when the second system resistance is detected, the belt transfer module 51 is retracted from the position of contact with the intermediate transfer body 30 to have the gap g (mm).

Since the gap g needs to be set in a range not causing discharging, the following settings are used in this example.

Specifically, from Paschen's law, a discharging start voltage Vs (kV) is expressed as follows under the normal temperature (20° C.)/normal pressure (1013 hPa) conditions.

$$Vs=24.4\ g+6.53\ (\sqrt{g})$$

Figure 17:
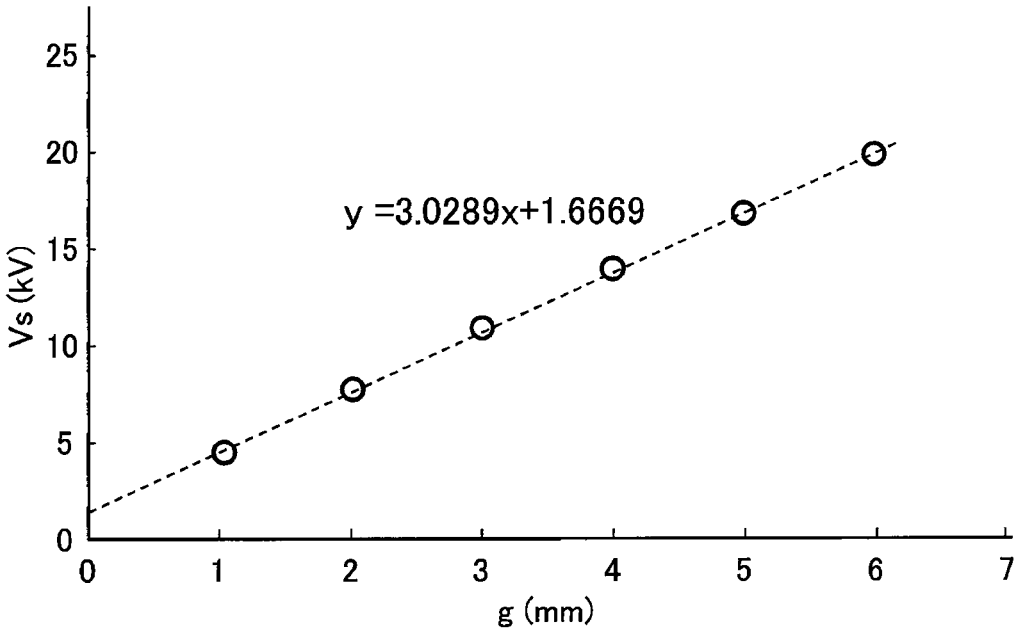
FIG. 17 is an explanatory graph illustrating a method for setting the length of a gap between a transfer belt and an intermediate transfer body in the second-resistance detection mode of an image forming apparatus according to Example 4.

FIG. 17 illustrates a linear approximation as a result of plotting a discharging start voltage Vs (kV) with respect to the gap g (mm) on the basis of the equation above. It is thereby understood that a voltage causing discharging is about 3 kV per mm.

Accordingly, it is understood that when the gap g between the intermediate transfer body 30 and the belt transfer module 51 is set at Vmax/3 (mm) or higher where Vmax (kV) is the maximum transfer voltage value of the transfer power supply 60, discharging is thereby reliably prevented.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding unit configured to hold an image;

a transfer unit including a transfer member and a counter member, wherein the transfer member is disposed in contact with an image holding surface of the image holding unit, wherein the counter member is disposed across the image holding unit from the transfer member, wherein the counter member is connected to a transfer power supply configured to cause a transfer electric field to act on a transfer region between the image holding unit and the transfer member, and wherein the transfer unit is configured to cause the image held by the image holding unit to be electrostatically transferred onto a recording medium transported to the transfer region;

a first-resistance detection unit configured to detect system resistance of the counter member, the image holding unit, and the transfer member;

a second-resistance detection unit configured to detect system resistance of the counter member alone or system resistance of the counter member and the image holding unit; and a selection unit configured to select the first-resistance detection unit or the second-resistance detection unit, depending on a type of the recording medium.

2. The image forming apparatus according to claim 1, wherein the selection unit is configured to select the first-resistance detection unit if the recording medium is a non-low-resistance recording medium having a resistance value higher than a predetermined resistance value, and wherein the selection unit is configured to select the second-resistance detection unit if the recording medium is a low-resistance recording medium having a resistance value lower than or equal to the predetermined resistance value.

3. The image forming apparatus according to claim 2, wherein the selection unit is configured to, if the recording medium is a low-resistance recording medium having a surface resistance of 8 log Ω or lower, then select the second-resistance detection unit.

4. The image forming apparatus according to claim 1, wherein the selection unit is configured to, if the recording medium has a conductive layer along a surface of a medium base material, then select the second-resistance detection unit.

5. The image forming apparatus according to claim 1, wherein the selection unit is configured to, if the recording medium is a black recording medium including a medium base material containing a conducting agent, then select the second-resistance detection unit.

6. The image forming apparatus according to claim 1, wherein the transfer unit is configured to, if the selection unit selects the second-resistance detection unit, then cause the transfer member to be retracted from the image holding unit to a non-contact position.

7. The image forming apparatus according to claim 6, wherein a gap between the image holding unit and the transfer member is set to prevent a voltage higher than or equal to a discharging start voltage from acting if the transfer unit causes the transfer member to be retracted from the image holding unit to the non-contact position.

8. The image forming apparatus according to claim 6, wherein the second-resistance detection unit comprises an ammeter configured to measure current flowing through the counter member if the transfer power supply applies a system-resistance detection voltage to the counter member in a state where the transfer member is retracted from the image holding unit.

9. The image forming apparatus according to claim 1, wherein the second-resistance detection unit comprises is an ammeter configured to measure current flowing to a contact unit that is located upstream of the transfer region in a recording-medium transport direction and that is grounded, wherein the transfer region is located between the image holding unit and the transfer member, and wherein the ammeter is configured to measure the current if the transfer power supply applies a system-resistance detection voltage to the counter member in a state where a recording medium used for system resistance detection lies between the transfer region and the contact unit.

10. An image forming apparatus comprising:

an image holding means for holding an image;

a transfer means for causing the image held by the image holding means to be electrostatically transferred onto a recording medium transported to a transfer region, wherein the transfer means includes a transfer member and a counter member, wherein the transfer member is disposed in contact with an image holding surface of the image holding means, wherein the counter member is disposed across the image holding means from the transfer member, and wherein the counter member is connected to a transfer power supply configured to cause a transfer electric field to act on the transfer region between the image holding means and the transfer member;

a first-resistance detection means for detecting system resistance of the counter member, the image holding means, and the transfer member;

a second-resistance detection means for detecting system resistance of the counter member alone or system resistance of the counter member and the image holding means; and a selection means for selecting the first-resistance detection means or the second-resistance detection means, depending on a type of the recording medium.

* * * * *